US012098855B2

(12) United States Patent
Ishimura et al.

(10) Patent No.: US 12,098,855 B2
(45) Date of Patent: Sep. 24, 2024

(54) AIR-CONDITIONING APPARATUS

(71) Applicant: Mitsubishi Electric Corporation, Tokyo (JP)

(72) Inventors: Katsuhiro Ishimura, Tokyo (JP); Naofumi Takenaka, Tokyo (JP); Yuji Motomura, Tokyo (JP); Hiroyuki Okano, Tokyo (JP); Naomichi Tamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 461 days.

(21) Appl. No.: 17/606,780

(22) PCT Filed: Jul. 25, 2019

(86) PCT No.: PCT/JP2019/029225
§ 371 (c)(1),
(2) Date: Oct. 27, 2021

(87) PCT Pub. No.: WO2021/014644
PCT Pub. Date: Jan. 28, 2021

(65) Prior Publication Data

US 2022/0205662 A1 Jun. 30, 2022

(51) Int. Cl.
*F24F 11/48* (2018.01)
*F24F 140/12* (2018.01)
(Continued)

(52) U.S. Cl.
CPC ..... *F24F 11/48* (2018.01); *F25B 30/02* (2013.01); *F25B 41/20* (2021.01);
(Continued)

(58) Field of Classification Search
CPC ..... F24F 11/48; F25B 2500/26; F25B 2400/04; F25B 41/20; F25B 2600/2501
See application file for complete search history.

(56) References Cited

U.S. PATENT DOCUMENTS

2013/0192283 A1 8/2013 Yamashita et al.
2015/0135751 A1 5/2015 Tamaki et al.

FOREIGN PATENT DOCUMENTS

EP 2 937 649 A1 10/2015
EP 3 062 031 A1 8/2016
(Continued)

OTHER PUBLICATIONS

International Search Report of the International Searching Authority mailed Aug. 27, 2019 in corresponding International Patent Application No. PCT/JP2019/029225 (and English translation).
(Continued)

*Primary Examiner* — Lionel Nouketcha
(74) *Attorney, Agent, or Firm* — Posz Law Group, PLC

(57) ABSTRACT

An air-conditioning apparatus includes a refrigerant circuit in which a compressor, a refrigerant flow switching device, a heat source side heat exchanger, an expansion device, a heat medium heat exchanger, and an accumulator are connected, a heat medium circuit in which a pump, the heat medium heat exchanger, a heat medium flow control device, and a load side heat exchanger are connected, at least one or more bypass pipes provided in the refrigerant circuit so that the refrigerant discharged from the compressor bypasses at least either one of the heat source side heat exchanger and the heat medium heat exchanger, a bypass opening and closing device provided at the bypass pipe, and a controller configured to control the bypass opening and closing device to carry out a start-up control function of causing low-pressure gas refrigerant with a high degree of superheat to flow into the accumulator.

19 Claims, 13 Drawing Sheets

(51) Int. Cl.

| | |
|---|---|
| ***F25B 30/02*** | (2006.01) |
| ***F25B 41/20*** | (2021.01) |
| *F24F 110/12* | (2018.01) |

(52) U.S. Cl.
CPC ..... *F24F 2110/12* (2018.01); *F24F 2140/12* (2018.01); *F25B 2400/04* (2013.01); *F25B 2500/31* (2013.01)

(56) References Cited

FOREIGN PATENT DOCUMENTS

| | | | |
|---|---|---|---|
| EP | 3 246 637 | A1 | 11/2017 |
| JP | 2000-097527 | A | 4/2000 |
| JP | 2011-117619 | A | 6/2011 |
| JP | 2016-205729 | A | 12/2016 |
| WO | 2012/073293 | A1 | 6/2012 |

OTHER PUBLICATIONS

Extended European Search Report dated Jun. 10, 2022 issued in corresponding European Patent Application No. 19938495.9.
Office Action dated Nov. 1, 2022 issued in corresponding JP Patent Application No. 2021-534514 (and English translation).
Office Action dated Feb. 13, 2024 issued in corresponding European Patent Application No. EP 19938495.9.

AIR-CONDITIONING APPARATUS

CROSS REFERENCE TO RELATED APPLICATION

This application is a U.S. national stage application of PCT/JP2019/029225 filed on Jul. 25, 2019, the contents of which are incorporated herein by reference.

TECHNICAL FIELD

The present disclosure relates to an air-conditioning apparatus including a refrigerant circuit.

BACKGROUND ART

An existing air-conditioning apparatus such as a multi-air-conditioner for use in a building may require a total extension of hundreds of meters of refrigerant pipes connecting an outdoor unit to a plurality of indoor units. Such an air-conditioning with long refrigerant pipes uses a very large amount of refrigerant. Therefore, in a case in which there occurs a refrigerant leak in such an air-conditioning apparatus, there is a possibility that a large amount of refrigerant may leak into one room.

Further, while there have recently been demands for conversion to refrigerants with low global warming potentials in view of global warming, many of the refrigerants with low global warming potentials are inflammable. In the case of future progress in the conversion to the refrigerants with low global warming potentials, consideration for safety is further required.

To solve the aforementioned problems, that is, problems related to reduction in the amount of refrigerant and consideration for safety of refrigerant, an air-conditioning apparatus employing a secondary loop system has been proposed (see, for example, Patent Literature 1). The air-conditioning apparatus of Patent Literature 1 is configured to circulate refrigerant through a primary side loop (refrigerant cycle circuit), circulate a harmless heat medium such as water or brine through a secondary side loop (heat medium cycle circuit), and transfer heating energy or cooling energy of the refrigerant to the heat medium. By having such a configuration, the air-conditioning apparatus of Patent Literature 1 can reduce the amount of refrigerant and ensure indoor safety of inflammable refrigerant.

CITATION LIST

Patent Literature

Patent Literature 1: International Publication No. 2012/073293

SUMMARY OF INVENTION

Technical Problem

However, since, under low outdoor temperature operating conditions, the air-conditioning apparatus of Patent Literature 1 suffers from the accumulation of refrigerant in an accumulator or other devices provided in the outdoor unit, the pressure of a refrigeration cycle may not be raised during starting of the air-conditioning apparatus. In such a case, the air-conditioning apparatus becomes unable to deliver its predetermined capacity, as the heat medium in the secondary loop becomes frozen during cooling operation or a heat exchanger provided in the outdoor unit becomes frosted during heating operation.

The present disclosure is intended to solve such a problem, and is intended to provide an air-conditioning apparatus capable of reducing deterioration of capacity even under low outdoor temperature operating conditions.

Solution to Problem

An air-conditioning apparatus according to one embodiment of the present disclosure includes a refrigerant circuit in which a compressor, a refrigerant flow switching device, a heat source side heat exchanger, an expansion device, a heat medium heat exchanger, and an accumulator are connected by a refrigerant pipe and through which refrigerant circulates, a heat medium circuit in which a pump, the heat medium heat exchanger, a heat medium flow control device, and a load side heat exchanger are connected by a heat medium pipe and through which a heat medium circulates, at least one or more bypass pipes provided in the refrigerant circuit so that the refrigerant discharged from the compressor bypasses at least either one of the heat source side heat exchanger and the heat medium heat exchanger, a bypass opening and closing device provided at a midpoint in a pipe conduit of the bypass pipe, and a controller configured to control the bypass opening and closing device to carry out a start-up control function of causing low-pressure gas refrigerant with a high degree of superheat to flow into the accumulator.

An air-conditioning apparatus according to another embodiment of the present disclosure includes a refrigerant circuit in which a compressor, a refrigerant flow switching device, a heat source side heat exchanger, an expansion device, a load side heat exchanger, and an accumulator are connected by a refrigerant pipe and through which refrigerant circulates, at least one or more bypass pipes provided in the refrigerant circuit so that the refrigerant discharged from the compressor bypasses at least either one of the heat source side heat exchanger and the load side heat exchanger, a bypass opening and closing device provided at a midpoint in a pipe conduit of the bypass pipe, and a controller configured to control the bypass opening and closing device to carry out a start-up control function of causing low-pressure gas refrigerant with a high degree of superheat to flow into the accumulator.

Advantageous Effects of Invention

An air-conditioning apparatus according to an embodiment of the present disclosure includes a controller configured to control the bypass opening and closing device to carry out a start-up control function of causing low-pressure gas refrigerant with a high degree of superheat to flow into the accumulator. Therefore, even under low outdoor temperature operating conditions, the air-conditioning apparatus can circulate refrigerant through the inside of the refrigerant circuit by gasifying liquid refrigerant accumulated in the accumulator. As a result, even under low outdoor temperature operating conditions, the air-conditioning apparatus can reduce deterioration of capacity due to freezing of the heat medium during cooling operation or due to formation of frost on the heat source side heat exchanger during heating operation.

DESCRIPTION OF EMBODIMENTS

In the following, an air-conditioning apparatus 100 according to an embodiment is described, for example, with reference to the drawings. It should be noted that embodiments of the drawings are examples and are not intended to limit the present disclosure. Further, constituent elements given identical reference signs in each drawing are identical or equivalent to each other, and these reference signs are adhered to throughout the full text of the description. Furthermore, in the following drawings, relative relationships in dimension between constituent elements, the shapes of the constituent elements, or other features of the constituent elements may be different from actual ones.

Embodiment 1

[Air-Conditioning Apparatus 100]

Figure 1:
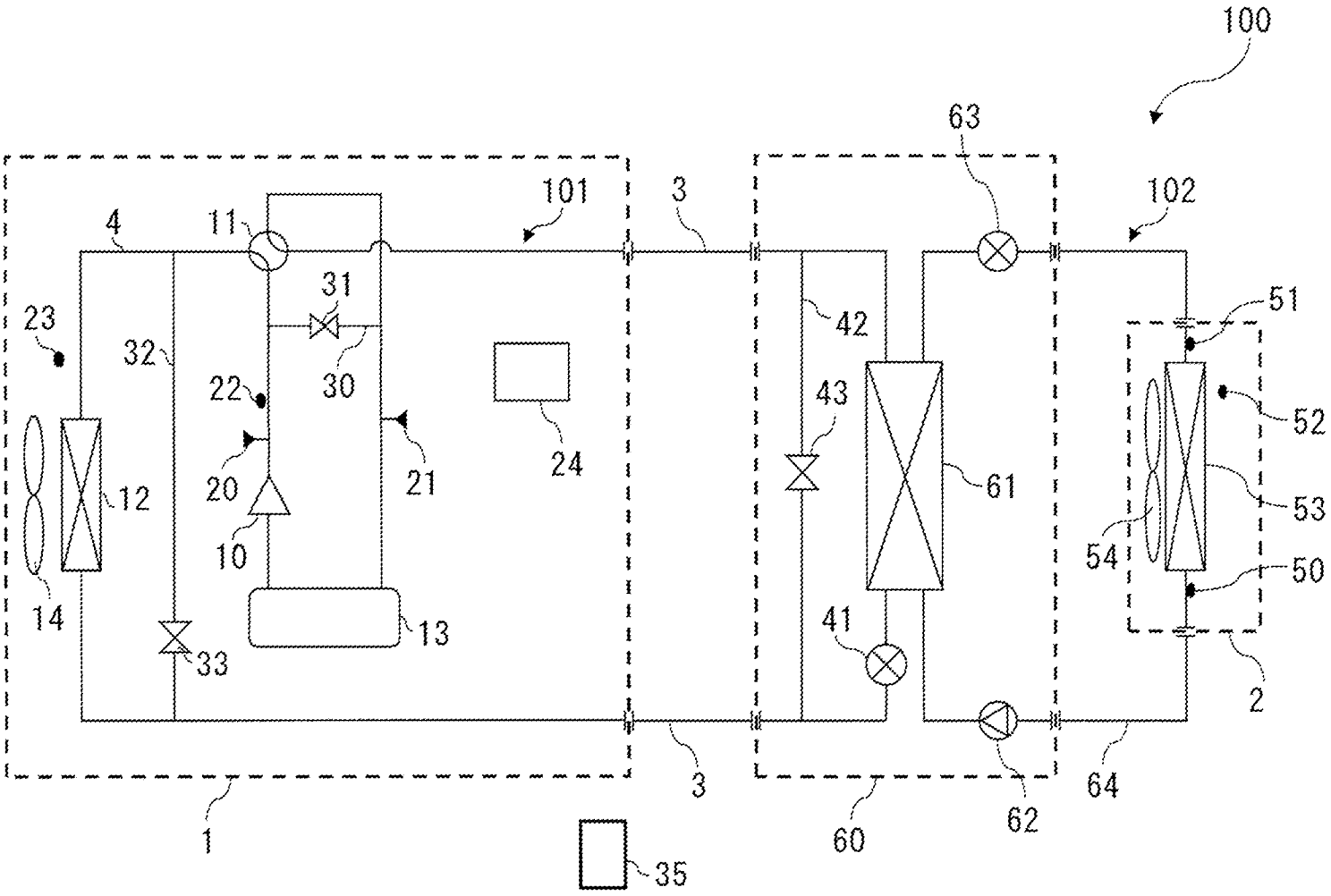
FIG. 1 is a schematic circuit configuration diagram showing an example of a circuit configuration of an air-conditioning apparatus according to Embodiment 1.

FIG. 1 is a schematic circuit configuration diagram showing an example of a circuit configuration of an air-conditioning apparatus 100 according to Embodiment 1. The configuration of the air-conditioning apparatus 100 is described in detail with reference to FIG. 1. This air-conditioning apparatus 100 is constituted by a refrigerant circuit 101 serving as a primary loop and a heat medium circuit 102 serving as a secondary loop. The air-conditioning apparatus 100 is configured to perform indoor air conditioning by transferring cooling energy or heating energy generated by utilizing a refrigeration cycle of the refrigerant circuit 101, which is the primary loop, to the heat medium circuit 102, which is the secondary loop, and utilizing the cooling energy or heating energy. The air-conditioning apparatus 100 transfers the heating energy or cooling energy generated in the refrigerant circuit 101 to a heat medium through a heat medium heat exchanger 61 and air-conditions indoor air through a load side heat exchanger 53.

The air-conditioning apparatus 100 includes an outdoor unit 1, a heat medium relay unit 60, and an indoor unit 2. The air-conditioning apparatus 100 shown in FIG. 1 illustrates an example in which the outdoor unit 1 and the heat medium relay unit 60 are connected by a refrigerant main pipe 3 to constitute the refrigerant circuit 101, which is the primary loop, and the heat medium relay unit 60 and the indoor unit 2 are connected by a heat medium pipe 64 to constitute the heat medium circuit 102, which is the secondary loop. As shown in FIG. 1, the refrigerant circuit 101, in which a compressor 10, a refrigerant flow switching device 11, a heat source side heat exchanger 12, an expansion device 41, the heat medium heat exchanger 61, and an accumulator 13 are connected by a refrigerant pipe 4, circulates refrigerant. Further, the heat medium circuit 102, in which a pump 62, the heat medium heat exchanger 61, a heat medium flow control device 63, and a load side heat exchanger 53 are connected by a heat medium pipe 64, circulates a heat medium. While the air-conditioning apparatus 100 shown in FIG. 1 illustrates, as an example, a case in which one indoor unit 2 is connected, a plurality of indoor units 2 may be connected. The air-conditioning apparatus 100 is switchable between a cooling only operation mode during which all indoor units in operation perform cooling and a heating only operation during which all indoor units perform heating.

[Outdoor Unit 1]

The outdoor unit 1 includes the compressor 10, the refrigerant flow switching device 11, the heat source side heat exchanger 12, and the accumulator 13. The compressor 10, the refrigerant flow switching device 11, the heat source side heat exchanger 12, and the accumulator 13 are connected by the refrigerant pipe 4. Further, the outdoor unit 1 includes an outdoor air-sending device 14. The outdoor air-sending device 14 is disposed near the heat source side heat exchanger 12. The outdoor air-sending device 14 sends air to the heat source side heat exchanger 12.

The compressor 10 suctions low-temperature and low-pressure refrigerant, compresses the refrigerant, and discharges it in a high-temperature and high-pressure state. Note here that the compressor 10 may include an inverter device and may be configured such that the capacity of the compressor 10 can be changed by varying the operating frequency with the inverter device.

The refrigerant flow switching device 11 is for example a four-way valve, and is a device configured to switch the direction of a refrigerant flow passage. The refrigerant flow switching device 11 is configured to switch between the flow of refrigerant during a cooling operation mode and the flow of refrigerant during a heating operation mode.

The heat source side heat exchanger 12 exchanges heat between refrigerant and outdoor air. The heat source side heat exchanger 12 acts as an evaporator during heating operation to evaporate and gasify refrigerant by exchanging heat between low-pressure refrigerant flowing in from the refrigerant pipe 4 and outside air. The heat source side heat exchanger 12 acts as a condenser during cooling operation to condense and liquefy refrigerant by exchanging heat between refrigerant flowing in from the refrigerant flow switching device 11 after being compressed by the compressor 10 and outdoor air. For enhanced efficiency in heat exchange between refrigerant and outdoor air, the outdoor air-sending device 14 is disposed adjacent to the heat source side heat exchanger 12.

The accumulator 13 has a refrigerant storage function of storing surplus refrigerant and a gas-liquid separation function based on the retention of liquid refrigerant temporarily generated during a change in operational state. The gas-liquid separation function of the accumulator 13 allows the outdoor unit 1 to prevent liquid compression from being performed by the compressor 10.

The outdoor unit 1 includes a first bypass pipe 30, a first bypass opening and closing device 31, a second bypass pipe 32, and a second bypass opening and closing device 33. The air-conditioning apparatus 100 includes at least one or more bypass pipes provided in the refrigerant circuit 101 so that the refrigerant discharged from the compressor 10 bypasses at least either the heat source side heat exchanger 12 or the heat medium heat exchanger 61.

The first bypass pipe 30 provides a bypass between a discharge side of the compressor 10 and a suction side of the accumulator 13. The first bypass opening and closing device 31 is provided at a midpoint in a pipe conduit of the first bypass pipe 30. The second bypass pipe 32 provides a bypass between portions of the refrigerant pipe 4 preceding and following the heat source side heat exchanger 12, and provides a bypass between a suction side and a projection side of the heat source side heat exchanger 12. That is, the second bypass pipe 32 is provided in parallel with the heat source side heat exchanger 12. The second bypass opening and closing device 33 is provided at a midpoint in a pipe conduit of the second bypass pipe 32. The first bypass opening and closing device 31 and the second bypass opening and closing device 33 are configured to block the flow of refrigerant through the bypass pipes. The first bypass opening and closing device 31 and the second bypass opening and closing device 33 need only be able to block the flow of refrigerant and, for example, may be constituted by solenoid valves or other devices.

The outdoor unit 1 includes a first pressure detection device 20 and a second pressure detection device 21. The first pressure detection device 20 and the second pressure detection device 21 are pressure detection devices configured to detect the pressure of refrigerant.

The first pressure detection device 20 is provided in a portion of the refrigerant pipe 4 connecting the discharge side of the compressor 10 to the refrigerant flow switching device 11. The first pressure detection device 20 is configured to detect the pressure of high-temperature and high-pressure refrigerant compressed and discharged by the compressor 10. The second pressure detection device 21 is provided in a portion of the refrigerant pipe 4 connecting the refrigerant flow switching device 11 to the suction side of the compressor 10. The second pressure detection device 21 is configured to detect the pressure of low-temperature and low-pressure refrigerant that is suctioned into the compressor 10.

Further, the outdoor unit 1 includes a first temperature detection device 22. The first temperature detection device 22 is a temperature detection device configured to detect the temperature of refrigerant. The first temperature detection device 22 is provided in the portion of the refrigerant pipe 4 connecting the discharge side of the compressor 10 to the refrigerant flow switching device 11. The first temperature detection device 22 is configured to detect the temperature of high-temperature and high-pressure refrigerant compressed and discharged by the compressor 10. The first temperature detection device 22 may be constituted, for example, by a thermistor or other devices.

Further, the outdoor unit 1 includes an outdoor temperature detection device 23. The outdoor temperature detection device 23 is configured to detect an outdoor ambient temperature. The outdoor temperature detection device 23 may be constituted, for example, by a thermistor or other devices.

The air-conditioning apparatus 100 includes any one or more of the outdoor temperature detection device 23, which detects an outdoor ambient temperature, the first pressure detection device 20, which detects the discharge pressure of the compressor 10, and the second pressure detection device 21, which detects the suction pressure of the compressor 10.

[Heat Medium Relay Unit 60]

The heat medium relay unit 60 is composed of two circuits, namely a portion of the refrigerant circuit 101 and a portion of the heat medium circuit 102. The portion of the refrigerant circuit 101 constituting the heat medium relay unit 60 includes the heat medium heat exchanger 61 and the expansion device 41. The heat medium heat exchanger 61 and the expansion device 41 are connected by the refrigerant pipe 4. The portion of the heat medium circuit 102 constituting the heat medium relay unit 60 includes the heat medium heat exchanger 61, the pump 62, and the heat medium flow control device 63. The heat medium heat exchanger 61, the pump 62, and the heat medium flow control device 63 are connected by the heat medium pipe 64. The heat medium relay unit 60 is installed in a machine room or a space such as a space above a ceiling.

The heat medium heat exchanger 61 is configured to exchange heat between refrigerant and a heat medium that are supplied from the outdoor unit 1. The heat medium heat exchanger 61 may be constituted, for example, by a plate heat exchanger. The indoor unit 2 can do cooling operation or heating operating by utilizing heat exchanged from the refrigerant to the heat medium by the heat medium heat exchanger 61.

The expansion device 41 functions as a pressure reducing valve or an expansion valve to expand refrigerant by reducing the pressure of the refrigerant. Highly efficient operation of the heat medium relay unit 60 can be attained by moving the expansion device 41 to adjust a degree of superheat or a degree of subcooling at an outlet of the heat medium heat exchanger 61. Therefore, it is desirable that the expansion device 41 have a controllable opening degree, and the expansion device 41 may be constituted, for example, by an electronic expansion valve or other devices.

The pump 62 conveys a heat medium flowing through the inside of the heat medium pipe 64 constituting the heat medium circuit 102. The heat medium is for example water, brine, or other substances.

The heat medium flow control device 63 adjusts the flow rate of a heat medium flowing through the inside of the heat medium pipe 64. It is preferable that the heat medium flow control device 63, which is configured to control the flow rate of a heat medium that is supplied to the indoor unit 2, be a mechanism whose opening degree can be arbitrarily adjusted. Further, by controlling the heat medium flow control device 63 to even out a temperature difference between the second temperature detection device 50 and the third temperature detection device 51, which will be described below and is provided in the indoor unit 2, the heat exchange capacity of the heat medium relay unit 60 is conveniently adjusted according to an indoor load.

While the air-conditioning apparatus 100 shown in FIG. 1 illustrates an example in which the heat medium flow control device 63 and the pump 62 are disposed inside the heat medium relay unit 60, the heat medium flow control device 63 and the pump 62 may be disposed outside the heat medium relay unit 60. For example, the heat medium flow control device 63 may be disposed inside the indoor unit 2, and the pump 62 may be disposed in a place that allows easy maintenance.

Further, the heat medium relay unit 60 includes a third bypass pipe 42 and a third bypass opening and closing device 43.

The third bypass pipe 42 provides a bypass between the heat medium heat exchanger 61 to the expansion device 41. The third bypass pipe 42 provides a bypass between portions of the refrigerant pipe 4 preceding and following the heat medium heat exchanger 61 and the expansion device 41. The third bypass pipe 42 is provided in parallel with the heat medium heat exchanger 61 and the expansion device 41 in the refrigerant circuit 101. The third bypass opening and closing device 43 is provided at a midpoint in a pipe conduit of the third bypass pipe 42. The third bypass opening and closing device 43 is configured to block the flow of refrigerant through the third bypass pipe 42. The third bypass opening and closing device 43 needs only be able to block the flow of refrigerant and, for example, may be constituted by a solenoid valve or other devices.

[Indoor Unit 2]

The indoor unit 2 includes a load side heat exchanger 53 and an indoor air-sending device 54. The indoor unit 2 is connected to the heat medium relay unit 60 via the heat medium pipe 64, and is configured such that a heat medium sent from the heat medium relay unit 60 flows into and out of the indoor unit 2. The load side heat exchanger 53 is configured, for example, to exchange heat between air supplied from the indoor air-sending device 54, such as a fan, and a heat medium and generate heating air or cooling air to be supplied to an indoor space. The indoor air-sending device 54 is disposed near the load side heat exchanger 53. The indoor air-sending device 54 sends air to the load side heat exchanger 53.

The indoor unit 2 includes a second temperature detection device 50, a third temperature detection device 51, and a fourth temperature detection device 52. The second temperature detection device 50 and the third temperature detection device 51 are provided in the heat medium circuit 102 so as to be on portions of the heat medium pipe 64 preceding and following the load side heat exchanger 53. The fourth temperature detection device 52 is provided in an inlet of air passing through the load side heat exchanger 53. The second temperature detection device 50, the third temperature detection device 51, and the fourth temperature detection device 52 may be constituted, for example, by thermistors or other devices.

The second temperature detection device 50 detects the temperature of a heat medium flowing into the load side heat exchanger 53. Further, the third temperature detection device 51 detects the temperature of a heat medium flowing out of the load side heat exchanger 53. Furthermore, the fourth temperature detection device 52 detects an indoor air temperature.

The air-conditioning apparatus 100 shown in FIG. 1 illustrates an example in which one indoor unit 2 is connected to the outdoor unit 1 via the heat medium relay unit 60. However, the air-conditioning apparatus 100 may be configured such that the number of indoor units 2 that are connected to one outdoor unit 1 is not limited to 1 and a plurality of indoor units 2 may be connected to the outdoor unit 1 via the heat medium relay unit 60. That is, the air-conditioning apparatus 100 may be configured to include a plurality of indoor units 2. In a case in which the number of indoor units 2 is large, the respective heat medium flow control devices 63 of the indoor units 2 may be disposed in parallel in the air-conditioning apparatus 100 so that heat medium flow rates can be adjusted separately according to each of loads generated in the indoor units 2.

[Controller 24]

Figure 2:
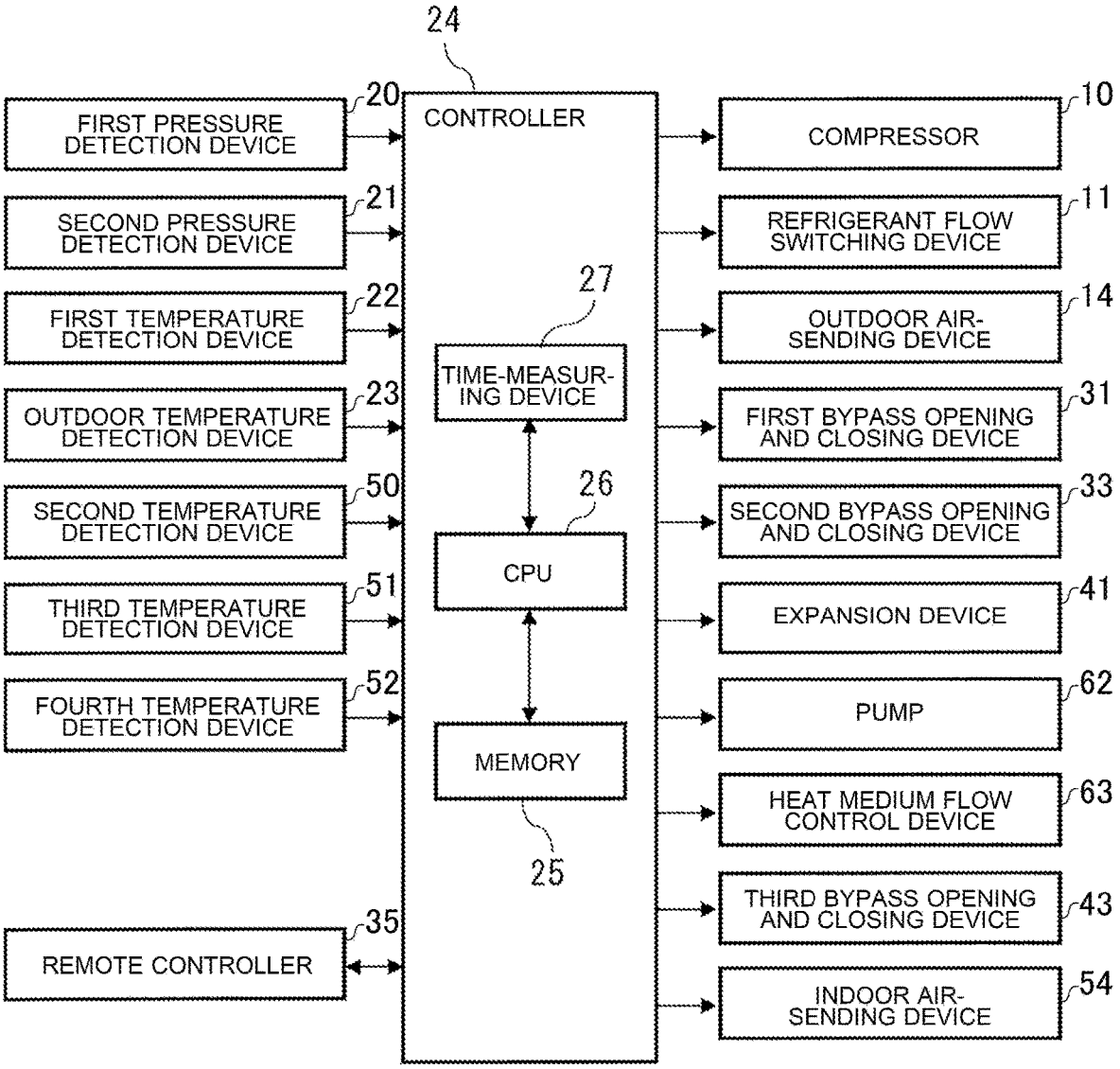
FIG. 2 is a block diagram showing an example configuration relating to control of the air-conditioning apparatus according to Embodiment 1.

FIG. 2 is a block diagram showing an example configuration relating to control of the air-conditioning apparatus 100 according to Embodiment 1. The air-conditioning apparatus 100 includes a controller 24. As shown in FIG. 2, the controller 24 includes a memory 25 having a program stored therein, a CPU 26 (central processing unit) configured to execute a process in accordance with the program, and a time-measuring device 27. The controller 24 is for example a microcomputer. Although, in the air-conditioning apparatus 100 shown in FIG. 1, the controller 24 is disposed in the outdoor unit 1, the placement of a controller 24 is not limited to the outdoor unit 1. For example, besides the controller 24 provided in the outdoor unit 1, controllers 24 may be provided separately in each of the units, namely the heat medium relay unit 60 and the indoor unit 2. Alternatively, the controller 24 may be provided in the outdoor unit 1, the heat medium relay unit, or the indoor unit 2.

The controller 24 is connected to the compressor 10, the refrigerant flow switching device 11, the outdoor air-sending device 14, the first bypass opening and closing device 31, and the second bypass opening and closing device 33 through a transmission line. The controller 24 is connected to the first pressure detection device 20, the second pressure detection device 21, the first temperature detection device 22, and the outdoor temperature detection device 23 through a transmission line. The controller 24 is connected to the expansion device 41, the pump 62, the heat medium flow control device 63, and the third bypass opening and closing device 43 through a transmission line. The controller 24 is connected to the indoor air-sending device 54, the second temperature detection device 50, the third temperature detection device 51, and the fourth temperature detection device 52 through a transmission line. The controller 24 has a cable or wireless communication connection with a remote controller 35.

The controller 24 receives pressures of refrigerant as detected by the first pressure detection device 20 and the second pressure detection device 21. Further, the controller 24 receives a temperature of refrigerant as detected by the first temperature detection device 22 and temperatures of a heat medium as detected by the second temperature detection device 50 and the third temperature detection device 51. Furthermore, the controller 24 receives an outdoor ambient temperature detected by the outdoor temperature detection device 23 and an indoor air temperature detected by the fourth temperature detection device 52.

The controller 24 controls the outdoor unit 1, the heat medium relay unit 60, and the indoor unit 2 in accordance with detected values of the various detection devices, the time elapsed, or instructions from the remote controller 35 to perform a refrigeration cycle control of executing each of the after-mentioned air-conditioning operation modes. The controller 24 controls, for example, the frequency of the compressor 10, the rotation speeds (including the turning on/off) of the outdoor air-sending device 14 and the indoor air-sending device 54, the switching of the refrigerant flow switching device 11, and the opening degree of the expansion device 41 based, for example, on the detected values of the various detection devices to execute each of the after-mentioned air-conditioning operation modes. Further, the controller 24 controls the valves of the first bypass opening and closing device 31, the second bypass opening and closing device 33, and the third bypass opening and closing device 43 based, for example, on the detected values of the various detection devices to switch between the opening and closing of the valves or adjust the opening degrees of the valves. Furthermore, the controller 24 controls the opening degree of the valve of the heat medium flow control device 63. Further, the controller 24 controls the driving and stopping of the pump 62 or controls the rotation speed of the pump 62.

The controller 24 controls the first bypass opening and closing device 31, the second bypass opening and closing device 33, and the third bypass opening and closing device 43 to carry out a start-up control function of causing low-pressure gas refrigerant with a high degree of superheat to flow into the accumulator 13 and thereby gasifying liquid refrigerant accumulated in the accumulator 13. The start-up control function carried out by the controller 24 controls the start-up of the air-conditioning apparatus 100 so that the refrigerant accumulated in the accumulator 13 is purged according to a detected value of the outdoor temperature detection device 23 when outdoor air temperature is low. Operation of the controller 24 related to the start-up control function will be described in detail later as a cooling start-up control function and a heating start-up control function.

[Memory 25]

The memory 25 has stored therein data that the controller 24 uses in performing various processes. The memory 25 includes a volatile storage device (not illustrated) such as a random-access memory (RAM) in which data can be temporarily stored or a nonvolatile auxiliary storage device (not illustrated) such as a hard disk or a flash memory in which data can be stored on a long-term basis. The memory 25 has a set value Ta stored in advance therein. The set value Ta is an arbitrary set value for a detected temperature of the outdoor temperature detection device 23. Similarly, the memory 25 has set values Pa and Pb stored in advance therein. The set value Pa is an arbitrary set value for a detected value of the first pressure detection device 20, and the set value Pb is an arbitrary value for a detected value of the second pressure detection device 21.

[Time-Measuring Device 27]

The time-measuring device 27 includes a timer or other devices, and measures time so that the controller 24 can determine time.

[Remote Controller 35]

The remote controller 35 is a piece of equipment that is utilized for a user to operate the air-conditioning apparatus 100. The remote controller 35 is provided with an input device for inputting a users instruction to the controller 24 of the air-conditioning apparatus 100. Further, the remote controller 35 may be provided with a display configured to display, for example, an operating state of the air-conditioning apparatus 100 based on the controller 24 such as various control modes such as cooling and heating, a set temperature, a room temperature detected, and the present time. The remote controller 35 is connected to the controller 24 either by cable or radio, communicates with the controller 24, and sends and receives signals to and from the controller 24. For example, in accordance with a user's or program's instruction, the remote controller 35 sends, to the controller 24, a start signal that causes the air-conditioning apparatus 100 to start operating. With this, the air-conditioning apparatus 100 causes the outdoor unit 1 and the indoor unit 2 to start operating. Further, in accordance with a users or program's instruction, the remote controller 35 sends, to the controller 24, a stop signal that causes the air-conditioning apparatus 100 to stop operating. With this, the air-conditioning apparatus 100 causes the outdoor unit 1 and the indoor unit 2 to stop operating.

[Heat Medium]

A usable example of a heat medium is brine (antifreeze), water, a mixture of brine and water, a mixture of water and a highly anticorrosive additive, or other substances. When a heat medium that is used is harmless to humans and highly safe, there is such an advantage that even if the heat medium leaks from the indoor unit 2 into an air-conditioned space, there occurs no safety hazard.

[Cooling Operation Mode]

Figure 3:
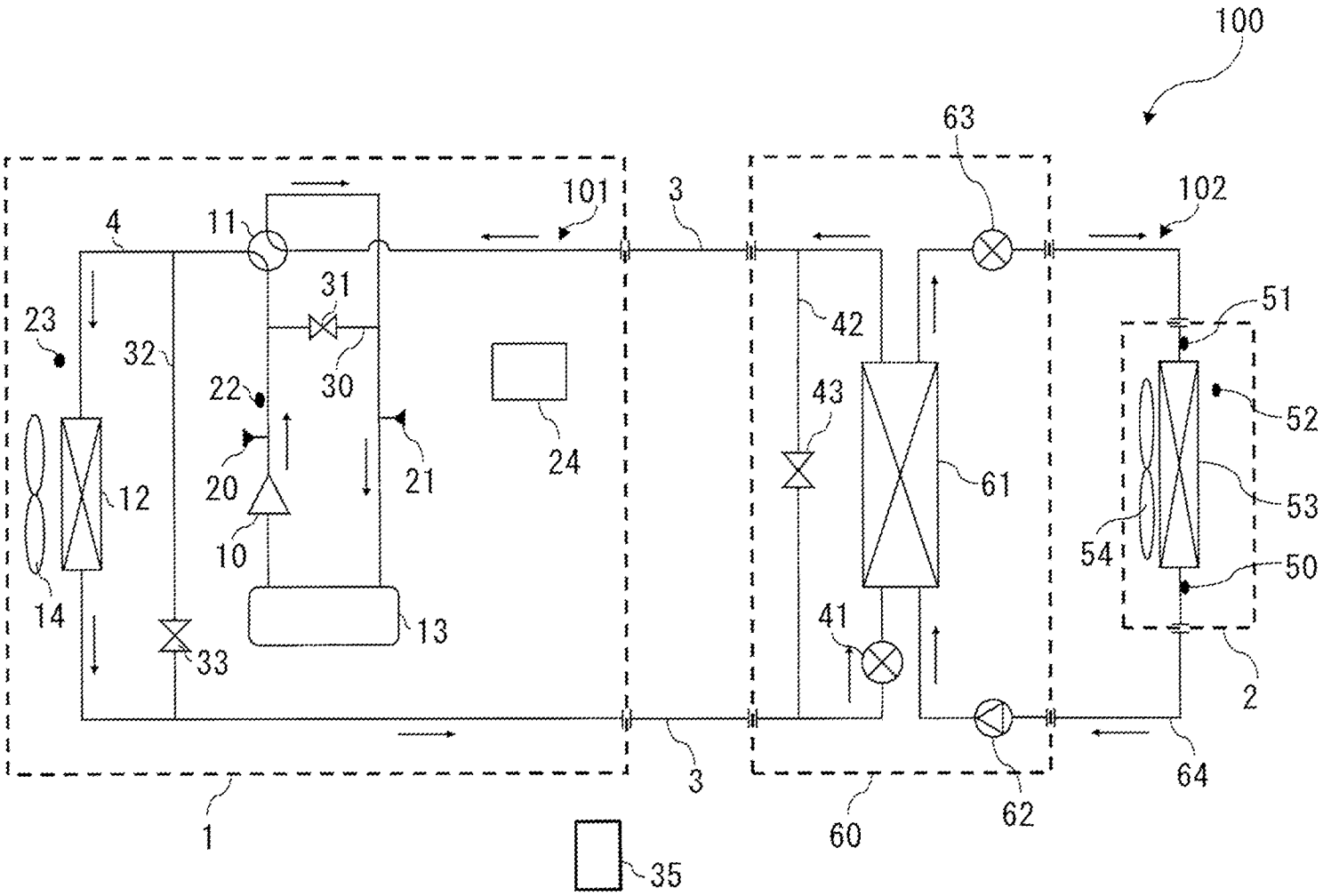
FIG. 3 is a circuit diagram showing the flows of refrigerant and a heat medium during a cooling operation mode of the air-conditioning apparatus according to Embodiment 1.

FIG. 3 is a circuit diagram showing the flows of refrigerant and a heat medium during a cooling operation mode of the air-conditioning apparatus 100 according to Embodiment 1. As shown in FIG. 3, the directions of flow of refrigerant and a heat medium are indicated by arrows. With reference to FIG. 3, the cooling operation mode is described by taking as an example a case in which a cooling load is generated in the load side heat exchanger 53.

To begin with, the flow of refrigerant through the refrigerant circuit 101, which constitutes the refrigeration cycle, is described. In the case of the cooling only operation mode, low-temperature and low-pressure refrigerant is compressed by the compressor 10 and discharged as high-temperature and high-pressure gas refrigerant. The high-temperature and high-pressure refrigerant discharged from the compressor 10 flows into the heat source side heat exchanger 12 via the refrigerant flow switching device 11. The high-temperature and high-pressure gas refrigerant having flowed into the heat source side heat exchanger 12 condenses into high-pressure liquid refrigerant while transferring heat to outdoor air. Then, the high-pressure liquid refrigerant having flowed out of the heat source side heat exchanger 12 flows out of the outdoor unit 1, passes through the refrigerant main pipe 3, and flows into the heat medium relay unit 60.

The high-pressure liquid refrigerant having flowed out of the outdoor unit 1 into the heat medium relay unit 60 is decompressed by the expansion device 41 into low-temperature and low-pressure two-phase refrigerant that then flows into the heat medium heat exchanger 61, which functions as an evaporator, cools the heat medium by removing heat from the heat medium, and turns into low-temperature and low-pressure gas refrigerant. The low-temperature and low-pressure gas refrigerant having flowed out of the heat medium heat exchanger 61 passes through the refrigerant main pipe 3 and flows into the outdoor unit 1. The refrigerant having flowed from the heat medium relay unit 60 into the outdoor unit 1 passes through the refrigerant flow switching device 11 and the accumulator 13 and is suctioned into the compressor 10.

Meanwhile, the controller 24 brings the first bypass opening and closing device 31 and the second bypass opening and closing device 33 into a closed state so that the outdoor unit 1 of the air-conditioning apparatus 100 prevents the refrigerant from bypassing inside the outdoor unit 1. In a case in which the first bypass opening and closing device 31 and the second bypass opening and closing device 33 are devices, such as solenoid valves, whose opening degrees are not adjustable, the controller 24 exercises control so that the first bypass opening and closing device 31 and the second bypass opening and closing device 33 are in a closed state during the cooling operation mode. Alternatively, in a case in which the first bypass opening and closing device 31 is a device, such as an electronic expansion valve, whose opening area is adjustable, the controller 24 may set the opening degree of the valve of the first bypass opening and closing device 31 during the cooling operation mode to such an opening degree that the operational state of the refrigeration cycle is not adversely affected. Similarly, in a case in which the second bypass opening and closing device 33 is a device, such as an electronic expansion valve, whose opening area is adjustable, the controller 24 may set the opening degree of the valve of the second bypass opening and closing device 33 during the cooling operation mode to such an opening degree that the operational state of the refrigeration cycle is not adversely affected. The clause "the operational state of the refrigeration cycle is not adversely affected" means, for example, that the cooling capacity is not adversely affected, and the phrase "such an opening degree that . . . is not adversely affected" is for example a totally-closed or almost totally-closed opening degree.

Similarly, the controller 24 may exercise control so that the third bypass opening and closing device 43 is in a closed state during the cooling operation mode. When the controller 24 brings the third bypass opening and closing device 43 into a closed state, the air-conditioning apparatus 100 can prevent the refrigerant from bypassing the heat medium heat exchanger 61 and reduce deterioration of the cooling capacity due to the bypassing of the refrigerant.

Further, the compressor 10 may be controlled by the controller 24 so that the detected value of the first pressure detection device 20 or the second pressure detection device 21 becomes a predetermined value. Alternatively, the compressor 10 may be controlled by the controller 24 so that the detected values of the first pressure detection device 20 and the second pressure detection device 21 become predetermined values. For example, when, in a case in which the air-conditioning apparatus 100 is in the cooling only operation mode, the controller 24 controls the compressor 10 so that an evaporating temperature that can be calculated from the detected value of the second pressure detection device 21 takes on a predetermined value, the compressor 10 can supply refrigerant at a flow rate appropriate to a cooling load needed in the indoor unit 2.

The outdoor air-sending device 14 may be controlled by the controller 24 so that the detected value of the first pressure detection device 20 or the second pressure detection device 21 becomes a predetermined value. Alternatively, the outdoor air-sending device 14 may be controlled by the controller 24 so that the detected values of the first pressure detection device 20 and the second pressure detection device 21 become predetermined values. For example, in a case in which the air-conditioning apparatus 100 is in the cooling only operation mode, the controller 24 may control the outdoor air-sending device 14 so that a condensing temperature that can be calculated from the detected value of the first pressure detection device 20 takes on a predetermined value.

The expansion device 41 may have its opening degree controlled by the controller 24 so that the degree of superheat at the outlet of the heat medium heat exchanger 61 becomes constant.

The following describes the flow of a heat medium through the heat medium circuit 102. During the cooling only operation mode of the air-conditioning apparatus 100, a heat medium having flowed out by being pressurized by the pump 62 flows into the heat medium heat exchanger 61. Cooling energy is transferred from heat source side refrigerant to the heat medium in the heat medium heat exchanger 61. The heat medium thus cooled flows out of the heat medium heat exchanger 61. The heat medium having flowed out of the heat medium heat exchanger 61 passes through the heat medium flow control device 63 and flows into the indoor unit 2 via the heat medium pipe 64. The heat medium having flowed into the indoor unit 2 cools the indoor space by removing heat from the indoor air in the load side heat exchanger 53. The heat medium having flowed out of the load side heat exchanger 53 flows back into the pump 62 via the heat medium pipe 64.

Meanwhile, to secure an air conditioning load needed in each room, the heat medium flow control device 63 has its opening degree adjusted by the controller 24 so that a temperature difference between a detected value of the second temperature detection device 50 and a detected value of the third temperature detection device 51 takes on a predetermined value (e.g. 2 to 7 degrees Celsius). Specifically, in a case in which the difference between the detected value of the second temperature detection device 50 and the detected value of the third temperature detection device 51 is smaller than the predetermined value, the opening degree of the heat medium flow control device 63 is adjusted in a closing direction by the controller 24. Further, in a case in which the difference between the detected value of the second temperature detection device 50 and the detected value of the third temperature detection device 51 is larger than the predetermined value, the opening degree of the heat medium flow control device 63 is adjusted in an opening direction by the controller 24. In this way, the heat medium flows into the load side heat exchanger 53 by being controlled by the controller 24 to be at a flow rate needed according to an air conditioning load needed in the room.

The pump 62 may have its output at a constant rotation speed. Alternatively, the pump 62 may have its rotation speed controlled by the controller 24 according to the temperature difference between the detected value of the second temperature detection device 50 and the detected value of the third temperature detection device 51. Alternatively, the pump 62 may have tis rotation speed controlled according to a temperature difference between a detected temperature of the fourth temperature detection device 52, which detects the room temperature of an air-conditioned space, and an indoor set temperature determined by a user.

[Heating Operation Mode]

Figure 4:
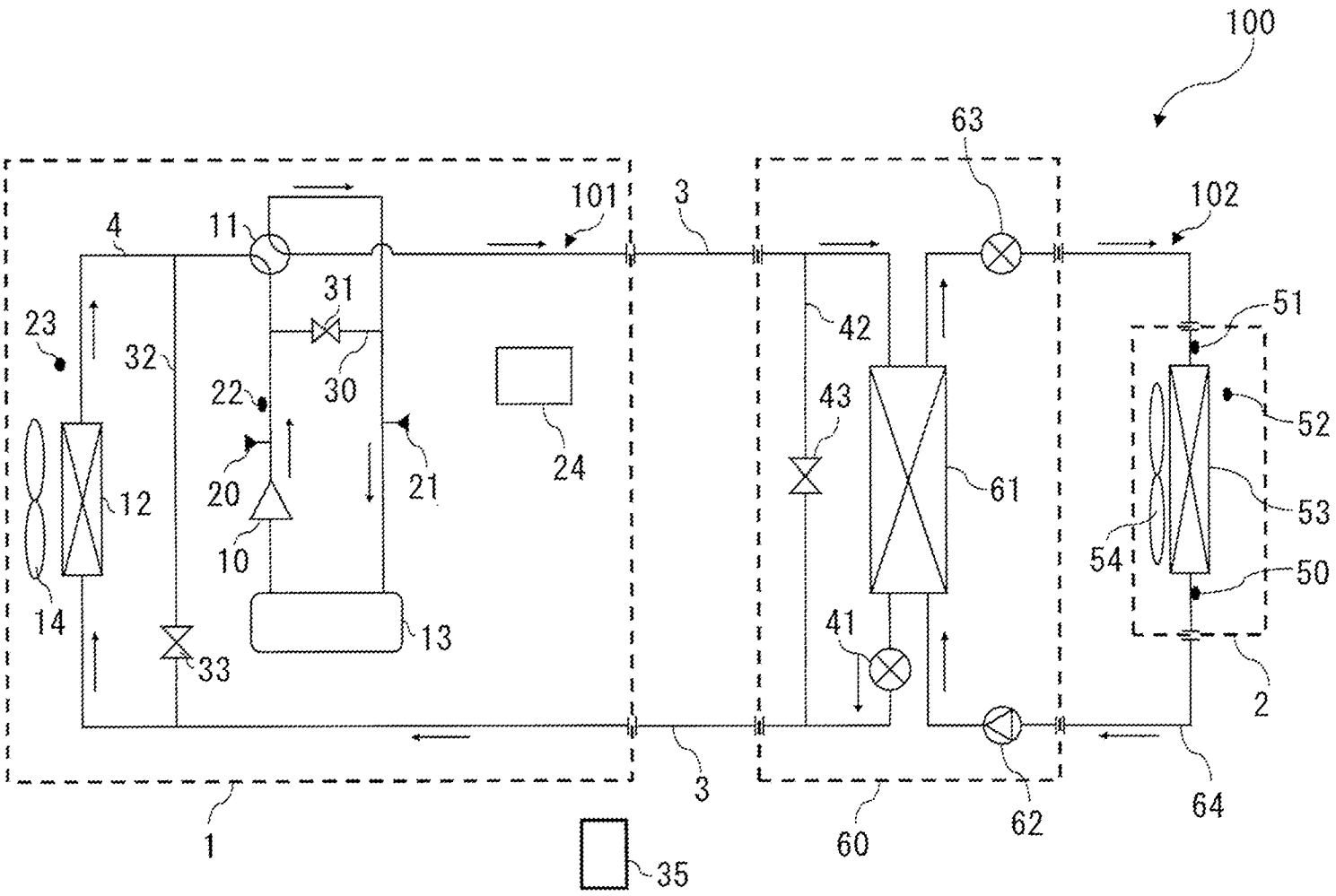
FIG. 4 is a circuit diagram showing the flows of refrigerant and a heat medium during a heating operation mode of the air-conditioning apparatus according to Embodiment 1.

FIG. 4 is a circuit diagram showing the flows of refrigerant and a heat medium during a heating operation mode of the air-conditioning apparatus 100 according to Embodiment 1. As shown in FIG. 4, the directions of flow of refrigerant and a heat medium are indicated by arrows. With reference to FIG. 4, the heating operation mode is described by taking as an example a case in which a heating load is generated in the load side heat exchanger 53.

To begin with, the flow of refrigerant through the refrigerant circuit 101, which constitutes the refrigeration cycle, is described. In the case of the heating only operation mode, low-temperature and low-pressure refrigerant is compressed by the compressor 10 and discharged as high-temperature and high-pressure gas refrigerant. The high-temperature and high-pressure refrigerant discharged from the compressor 10 flows out of the outdoor unit 1 via the refrigerant flow switching device 11, passes through the refrigerant main pipe 3, and flows into the heat medium relay unit 60. The high-temperature and high-pressure gas refrigerant having flowed into the heat medium relay unit 60 flows into the heat medium heat exchanger 61 and condenses into high-pressure liquid refrigerant while transferring heat to the heat medium. The high-pressure liquid refrigerant having flowed out of the heat medium heat exchanger 61 flows into the expansion device 41. Then, the high-pressure liquid refrigerant having flowed into the expansion device 41 is decompressed by the expansion device 41 into low-temperature and low-pressure two-phase refrigerant that then flows out of the heat medium relay unit 60, passes through the refrigerant main pipe 3, and flows into the outdoor unit 1.

The low-temperature and low-pressure two-phase refrigerant having flowed into the outdoor unit 1 flows into the heat source side heat exchanger 12, which functions as an evaporator, and evaporates into low-temperature and low-pressure gas refrigerant by receiving heat from air. The low-temperature and low-pressure gas refrigerant having flowed out of the heat source side heat exchanger 12 passes through the refrigerant flow switching device 11 and the accumulator 13 and is suctioned into the compressor 10.

Meanwhile, the controller 24 brings the first bypass opening and closing device 31 and the second bypass opening and closing device 33 into a closed state so that the outdoor unit 1 of the air-conditioning apparatus 100 prevents the refrigerant from bypassing inside the outdoor unit 1. In a case in which the first bypass opening and closing device 31 and the second bypass opening and closing device 33 are devices, such as solenoid valves, whose opening degrees are not adjustable, the controller 24 exercises control so that the first bypass opening and closing device 31 and the second bypass opening and closing device 33 are in a closed state during the heating operation mode. Alternatively, in a case in which the first bypass opening and closing device 31 is a device, such as an electronic expansion valve, whose opening area is adjustable, the controller 24 may set the opening degree of the valve of the first bypass opening and closing device 31 during the heating operation mode to such an opening degree that the operational state of the refrigeration cycle is not adversely affected. Similarly, in a case in which the second bypass opening and closing device 33 is a device, such as an electronic expansion valve, whose opening area is adjustable, the controller 24 may set the opening degree of the valve of the second bypass opening and closing device 33 during the heating operation mode to such an opening degree that the operational state of the refrigeration cycle is not adversely affected. The clause "the operational state of the refrigeration cycle is not adversely affected" means, for example, that the heating capacity is not adversely affected, and the phrase "such an opening degree that . . . is not adversely affected" is for example a totally-closed or almost totally-closed opening degree.

Similarly, the controller 24 may exercise control so that the third bypass opening and closing device 43 is in a closed state during the heating operation mode. When the controller 24 brings the third bypass opening and closing device 43 into a closed state, the air-conditioning apparatus 100 can prevent the refrigerant from bypassing the heat medium heat exchanger 61 and reduce deterioration of the heating capacity due to the bypassing of the refrigerant.

Further, the compressor 10 may be controlled by the controller 24 so that the detected value of the first pressure detection device 20 or the second pressure detection device 21 becomes a predetermined value. Alternatively, the compressor 10 may be controlled by the controller 24 so that the detected values of the first pressure detection device 20 and the second pressure detection device 21 become predetermined values. For example, when, in a case in which the air-conditioning apparatus 100 is in the heating only operation mode, the controller 24 controls the compressor 10 so that a condensing temperature that can be calculated from the detected value of the first pressure detection device 20 takes on a predetermined value, the compressor 10 can supply refrigerant at a flow rate appropriate to a heating load needed in the indoor unit 2.

The outdoor air-sending device 14 may be controlled by the controller 24 so that the detected value of the first pressure detection device 20 or the second pressure detection device 21 becomes a predetermined value. Alternatively, the outdoor air-sending device 14 may be controlled by the controller 24 so that the detected values of the first pressure detection device 20 and the second pressure detection device 21 become predetermined values. For example, in a case in which the air-conditioning apparatus 100 is in the heating only operation mode, the controller 24 may control the outdoor air-sending device 14 so that an evaporating temperature that can be calculated from the detected value of the second pressure detection device 21 takes on a predetermined value.

The expansion device 41 may have its opening degree controlled by the controller 24 so that the degree of subcooling at the outlet of the heat medium heat exchanger 61 becomes constant.

The following describes the flow of a heat medium through the heat medium circuit 102. During the heating only operation mode of the air-conditioning apparatus 100, a heat medium having flowed out by being pressurized by the pump 62 flows into the heat medium heat exchanger 61. Heating energy is transferred from heat source side refrigerant to the heat medium in the heat medium heat exchanger 61. The heat medium thus heated flows out of the heat medium heat exchanger 61. The heat medium having flowed out of the heat medium heat exchanger 61 passes through the heat medium flow control device 63 and flows into the indoor unit 2 via the heat medium pipe 64. The heat medium having flowed into the indoor unit 2 heats the indoor space by transferring heat to the indoor air in the load side heat exchanger 53. The heat medium having flowed out of the load side heat exchanger 53 flows back into the pump 62 via the heat medium pipe 64.

Meanwhile, to secure an air conditioning load needed in each room, the heat medium flow control device 63 has its opening degree adjusted by the controller 24 so that a temperature difference between a detected value of the second temperature detection device 50 and a detected value of the third temperature detection device 51 takes on a predetermined value (e.g. 5 to 10 degrees Celsius). Specifically, in a case in which the difference between the detected value of the second temperature detection device 50 and the detected value of the third temperature detection device 51 is smaller than the predetermined value, the opening degree of the heat medium flow control device 63 is adjusted in a closing direction by the controller 24. Further, in a case in which the difference between the detected value of the second temperature detection device 50 and the detected value of the third temperature detection device 51 is larger than the predetermined value, the opening degree of the heat medium flow control device 63 is adjusted in an opening direction by the controller 24. In this way, the heat medium flows into the load side heat exchanger 53 by being controlled by the controller 24 to be at a flow rate needed according to an air conditioning load needed in the room.

The pump 62 may have its output at a constant rotation speed. Alternatively, the pump 62 may have its output adjusted by the controller 24 according to a temperature difference between indoor temperature that is a detected value of the fourth temperature detection device 52, which detects the room temperature of an air-conditioned space, and an indoor set temperature determined by a user. Alternatively, the pump 62 may be controlled to have its output adjusted by the controller 24 so that a temperature difference between temperature detection devices (not illustrated) provided in front of and behind a heat medium side flow passage of the heat medium heat exchanger 61 takes on a predetermined value (e.g. 5 to 10 degrees Celsius).

[Cooling Start-Up Control Function During Cooling Operation Mode]

Figure 5:
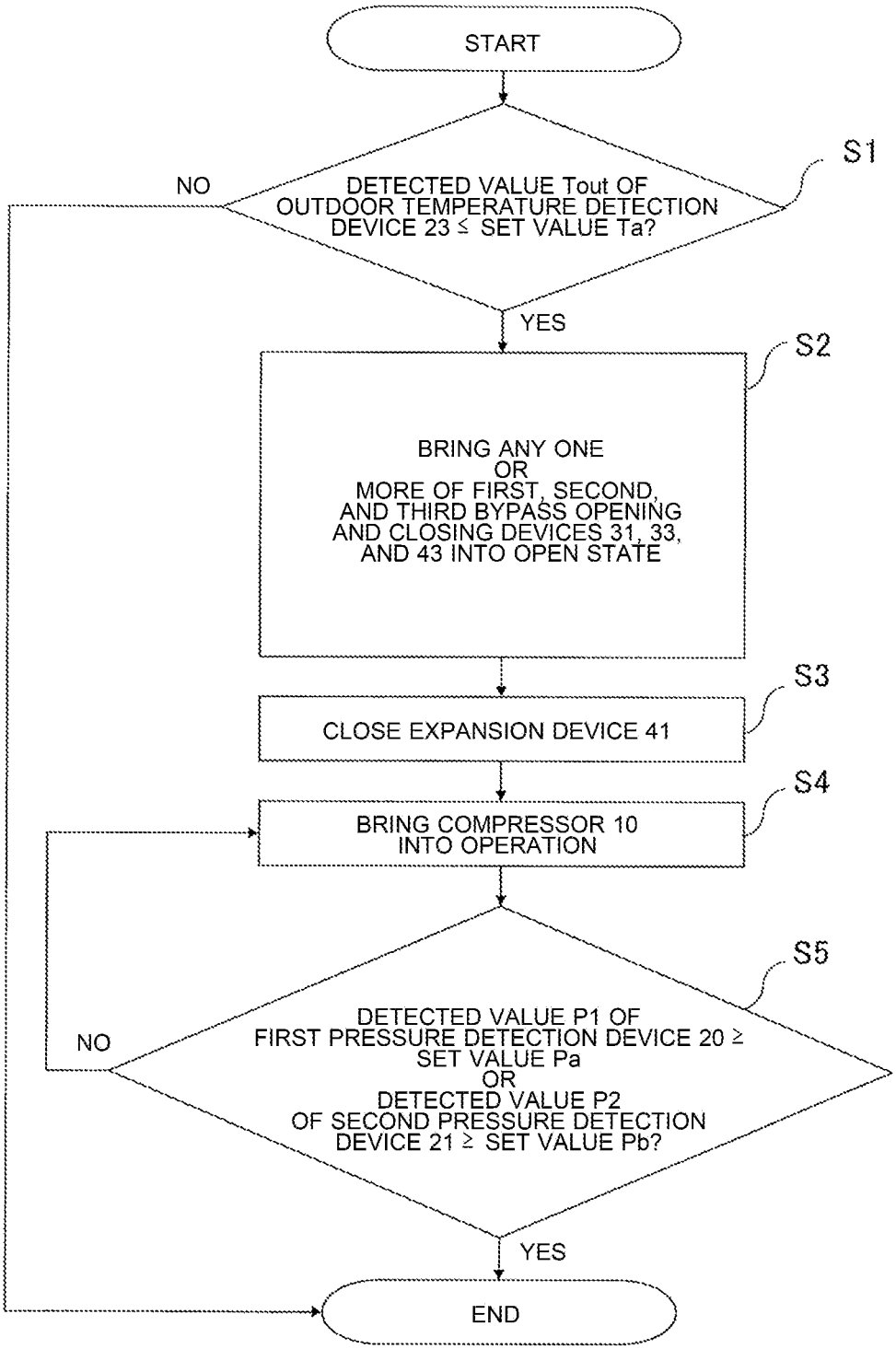
FIG. 5 is a flow chart showing operation of a cooling start-up control function and a heating start-up control function of the air-conditioning apparatus according to Embodiment 1.

FIG. 5 is a flow chart showing operation of a cooling start-up control function and a heating start-up control function of the air-conditioning apparatus 100 according to Embodiment 1. The following describes, with reference to FIG. 5, the cooling start-up control function of, at the start of cooling operation under low outside air temperature conditions, purging refrigerant accumulated in the accumulator 13. The cooling start-up control function and the heating start-up control function are functions of the air-conditioning apparatus 100 that are executed by the controller 24, and functions that, by causing low-pressure gas refrigerant with a high degree of superheat to flow into the accumulator 13, gasify liquid refrigerant accumulated in the accumulator 13.

FIG. 5 is a flow chart representing operation of the cooling start-up control function during the cooling operation mode. When the remote controller 35 is operated by a user and cooling operation gets started, the air-conditioning apparatus 100 starts the cooling start-up control function and performs an operation according to the flow chart shown in FIG. 5. As for various devices in the air-conditioning apparatus 100 whose actions are not defined in the flow chart shown in FIG. 5, actions are performed according to the aforementioned cooling operation mode.

First, the controller 24 determines whether a detected temperature Tout of the outdoor temperature detection device 23 is less than or equal to a set value Ta, which is an arbitrary set value (step S1). The set value Ta may be set, for example, to 5 degrees Celsius, as liquid refrigerant is more easily accumulated in the accumulator 13 at lower outdoor temperatures. In a case in which the controller 24 has determined that the detected temperature Tout of the outdoor temperature detection device 23 is greater than the set value Ta (NO in step S1), the controller 24 performs the operation of the aforementioned cooling operation mode without carrying out the cooling start-up control function. In a case in which the controller 24 has determined that the detected temperature Tout of the outdoor temperature detection device 23 is less than or equal to the set value Ta (YES in step S1), the controller 24 determines that liquid refrigerant is present in the accumulator 13, and proceeds to a process of executing step S2.

Next, the controller 24 brings any one or more of the first bypass opening and closing device 31, the second bypass opening and closing device 33, and the third bypass opening and closing device 43 into an open state (step S32). In step S2, although the controller 24 is supposed to open any one of the three bypass opening and closing devices, the controller 24 may open two of them or may open all of them. The more bypass opening and closing devices are opened, the earlier the air-conditioning apparatus 100 can gasify the liquid refrigerant contained in the accumulator 13. The open and closed states of the first bypass opening and closing device 31, the second bypass opening and closing device 33, and the third bypass opening and closing device 43 may be stored in advance as control actions in the memory 25 of the controller 24. Properties of the three bypass opening and closing devices, such as the numbers of times they are opened and closed, the open and closed positions, and the opening degrees, may be stored in advance as control actions in the memory 25 of the controller 24. Alternatively, the controller 24 may control the open and closed states of the three bypass opening and closing devices according to the operational state of the air-conditioning apparatus 100. Examples of the operational state include, but are not limited to, outdoor temperature, indoor temperature, and the number of indoor units 2 in operation. For example, the controller 24 may control the bypass opening and closing devices so that the number of bypass opening and closing devices that are brought into an open state increases as the difference between the outdoor temperature that is detected by the outdoor temperature detection device 23 and the evaporating temperature that is computed from the detected value of the second pressure detection device 21 increases. Further, the controller 24 may control a priority order of opening of the bypass opening and closing devices so that during the cooling operation mode, the second bypass opening and closing device 33 opens always first of the second bypass opening and closing device 33 and the third bypass opening and closing device 43. Further, the controller 24 may control the priority order of opening of the bypass opening and closing devices so that during the heating operation mode, the third bypass opening and closing device 43 opens always first of the second bypass opening and closing device 33 and the third bypass opening and closing device 43. That is, it is desirable that the controller 24 control the opening and closing states of the bypass opening and closing devices so that the condenser, which performs liquefaction, is bypassed first of the condenser and the evaporator. Having performed the process of step S2, the controller 24 proceeds to a process of executing step S3.

Next, the controller 24 closes the expansion device 41 so that low-temperature refrigerant does not flow into the heat medium heat exchanger 61 (step S3). Closing the expansion device 41 means making the opening degree of the expansion device 41 a totally-closed or almost totally-open opening degree. Having performed the process of step S3, the controller 24 proceeds to a process of executing step S4.

Next, the controller 24 brings the compressor 10 into operation (step S4). That is, the controller 24 brings the compressor 10 into operation after, at the start of cooling operation, bringing at least one or more bypass opening and closing devices into an open state. Bringing the compressor 10 into operation based on the processes from step S1 to step S4 causes high-temperature and high-pressure gas refrigerant discharged from the compressor 10 to pass through any one or more of the first bypass pipe 30, the second bypass pipe 32, and the third bypass pipe 42. Then, the high-temperature and high-pressure gas refrigerant discharged from the compressor 10 passes through a bypass opening and closing device such as the first bypass opening and closing device 31, the second bypass opening and closing device 33, or the third bypass opening and closing device 43 to flow into the accumulator 13. The high-temperature and high-pressure gas refrigerant discharged from the compressor 10 is decompressed into low-pressure refrigerant while passing through the bypass opening and closing device such as the first bypass opening and closing device 31. That is, the bypass opening and closing device such as the first bypass opening and closing device 31 serves as a boundary between high and low pressures of refrigerant. Then, since refrigerant drops in temperature when decompressed, the refrigerant having just passed through the bypass opening and closing device such as the first bypass opening and closing device 31 turns into low-pressure intermediate-temperature refrigerant. However, the temperature of the refrigerant is an intermediate temperature as compared with the temperature of a discharge portion of the compressor 10, but is a high temperature as compared with the temperature of liquid refrigerant present in the accumulator 13. Therefore, this low-pressure intermediate-temperature refrigerant is low-pressure gas refrigerant with a high degree of superheat that is capable of evaporating the refrigerant contained in the accumulator 13. The air-conditioning apparatus 100 allows the gas refrigerant with a high degree of superheat discharged from the compressor 10 to bypass the heat source side heat exchanger 12 or the heat medium heat exchanger 61 and flow directly into the accumulator 13. As a result, by causing the low-pressure gas refrigerant with a high degree of superheat to flow into the accumulator 13, the air-conditioning apparatus 100 can raise the system pressure of the refrigeration cycle by heating, evaporating, and thereby gasifying the liquid refrigerant accumulated in the accumulator 13.

Bringing the compressor 10 into operation in step S4 causes low-temperature refrigerant to flow into the heat medium heat exchanger 61. Therefore, operating the pump 62 and the heat medium flow control device 63 before the start of the operation of the compressor 10 so that the heat medium circulates through the inside of the heat medium circuit 102 can make it hard for the heat medium to freeze in the heat medium heat exchanger 61. That is, it is desirable that the controller 24 exercise control so that the compressor 10 is activated after the pump 62 and the heat medium flow control device 63 have been activated. Having performed the process of step S4, the controller 24 proceeds to a determination process of step S5.

Next, the controller 24 determines whether a detected value P1 of the first pressure detection device 20 is greater than or equal to the set value Pa, which is an arbitrary set value, and determines whether a detected value P2 of the second pressure detection device 21 is greater than or equal to the set value Pb, which is an arbitrary set value. Then, the controller 24 determines whether either the condition that the detected value P1 of the first pressure detection device 20 is greater than or equal to the set value Pa or the condition that the detected value P2 of the second pressure detection device 21 is greater than or equal to the set value Pb is met (step S5). In a case in which the controller 24 has determined that either of the conditions is met (YES in step S5), the controller 24 determines that the liquid refrigerant has been successfully purged from the accumulator 13, terminates the cooling start-up control function, and shifts to a normal cooling operation mode. In a case in which the controller 24 has determined that neither of the conditions is met (NO in step S5), the controller 24 determines that the liquid refrigerant is present in the accumulator 13, and returns to the determination process of step S4.

It should be noted that the method for determining a condition for the termination of the cooling start-up control function in step S5 is not limited to the aforementioned method. The termination of the cooling start-up control function may be determined by a value that is calculated by the detected value of the first pressure detection device 20 or the detected value of the second pressure detection device 21, for example, the saturation temperature of refrigerant or other values. Alternatively, the termination of the cooling start-up control function may be done by providing, at an inflow side of the accumulator 13, a temperature detection device (not illustrated) configured to detect the temperature of refrigerant, calculating a degree of superheat of refrigerant flowing into the accumulator 13, and using the degree of superheat as a value for determination of a termination condition. Alternatively, the controller 24 may use the time-measuring device 27 to terminate the cooling start-up control function in a case in which a period of time elapsed after the start of the cooling start-up control function reaches a set period of time. That is, the controller 24 may terminate the start-up control function in a case in which the detected value of at least one or more of the first pressure detection device 20 and the second pressure detection device 21 is less than or equal to a threshold or a case in which the period of time elapsed after the start of the start-up control function reaches the set period of time.

Figure 6:
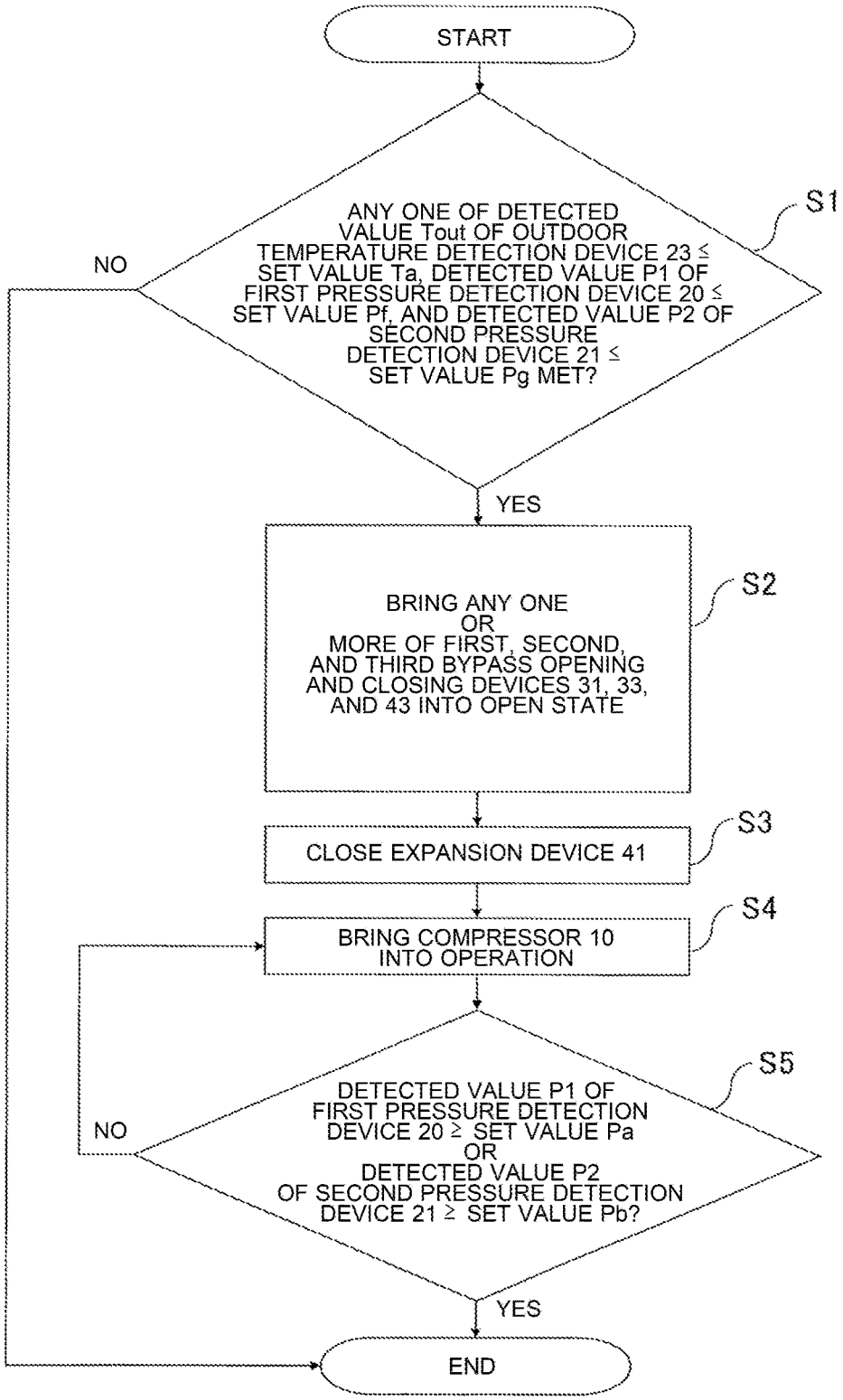
FIG. 6 is a flow chart showing another example of operation of the cooling start-up control function and the heating start-up control function of the air-conditioning apparatus according to Embodiment 1.

FIG. 6 is a flow chart showing another example of operation of the cooling start-up control function and the heating start-up control function of the air-conditioning apparatus 100 according to Embodiment 1. The air-conditioning apparatus 100 may carry out the cooling start-up control function in a case in which the detected value of the first pressure detection device 20 or the second pressure detection device 21 is less than or equal to the set value. Accordingly, in starting the air-conditioning operation of the air-conditioning apparatus 100, the controller 24 can carry out the start-up control function based on the detected value of at least one or more of the outdoor temperature detection device 23, the first pressure detection device 20, and the second pressure detection device 21. In this case, the controller 24 carries out the cooling start-up control function if any one of the condition that the detected value P1 of the first pressure detection device 20 is less than or equal to a set value Pf, the condition that the detected value P2 of the second pressure detection device 21 is less than or equal to a set value Pg, and the condition that the detected temperature Tout of the outdoor temperature detection device 23 is less than or equal to the set value Ta is met in step S1. Further, although the condition for the start of the cooling start-up control function shown in FIG. 5 begins at the start of cooling operation, a condition for the start of a cooling start-up control function does not need to begin at the start of cooling operation. For example, even in a state in which the air-conditioning apparatus 100 is under suspension, the air-conditioning apparatus 100 may carry out the cooling start-up control function at regular time intervals. While the air-conditioning apparatus 100 is under suspension, the controller 24 can carry out the start-up control function based on the detected value of at least one or more of the outdoor temperature detection device 23, the first pressure detection device 20, and the second pressure detection device 21 at set time intervals. In this case, the controller 24 carries out the cooling start-up control function in a case in which the detected value is less than or equal to the set value. That is, the controller 24 carries out the cooling start-up control function if any one of the condition that the detected value P1 of the first pressure detection device 20 is less than or equal to the set value Pf, the condition that the detected value P2 of the second pressure detection device 21 is less than or equal to the set value Pg, and the condition that the detected temperature Tout of the outdoor temperature detection device 23 is less than or equal to the set value Ta is met in step S1. Since the air-conditioning apparatus 100 can prevent accumulation of refrigerant in the accumulator 13 by executing the cooling start-up control function, the air-conditioning apparatus 100 can prevent the heat medium from freezing at the start of cooling operation under low outside air temperature conditions.

By carrying out the cooling start-up control function, the air-conditioning apparatus 100 can efficiently gasify the liquid refrigerant accumulated in the accumulator 13. Therefore, at the start of cooling operation under low outside air temperature conditions, the air-conditioning apparatus 100 can reduce deterioration of the cooling capacity due to a decrease in system pressure in a case in which a large amount of refrigerant is accumulated in the accumulator 13.

[Heating Start-Up Control Function During Heating Operation Mode]

The following describes, with reference to FIG. 5, the heating start-up control function of, at the start of heating operation under low outside air temperature conditions, purging refrigerant accumulated in the accumulator 13.

FIG. 5 is also a flow chart representing operation of the heating start-up control function during the heating operation mode. When the remote controller 35 is operated by a user and heating operation gets started, the air-conditioning apparatus 100 starts the heating start-up control function and performs an operation according to the flow chart shown in FIG. 5. As for various devices in the air-conditioning apparatus 100 whose actions are not defined in the flow chart shown in FIG. 5, actions are performed according to the aforementioned heating operation mode.

First, the controller 24 determines whether a detected temperature Tout of the outdoor temperature detection device 23 is less than or equal to a set value Ta, which is an arbitrary set value (step S1). The set value Ta may be set, for example, to 5 degrees Celsius, as refrigerant is more easily accumulated in the accumulator 13 at lower outdoor temperatures. In a case in which the controller 24 has determined that the detected temperature Tout of the outdoor temperature detection device 23 is greater than the set value Ta (NO in step S1), the controller 24 performs the operation of the aforementioned heating operation mode without carrying out the heating start-up control function. In a case in which the controller 24 has determined that the detected temperature Tout of the outdoor temperature detection device 23 is less than or equal to the set value Ta (YES in step S1), the controller 24 determines that liquid refrigerant is present in the accumulator 13, and proceeds to a process of executing step S2.

Next, the controller 24 brings any one or more of the first bypass opening and closing device 31, the second bypass opening and closing device 33, and the third bypass opening and closing device 43 into an open state (step S2). In step S2, although the controller 24 is supposed to open any one of the three bypass opening and closing devices, the controller 24 may open two of them or may open all of them. The more bypass opening and closing devices are opened, the earlier the air-conditioning apparatus 100 can gasify the liquid refrigerant contained in the accumulator 13. Having performed the process of step S2, the controller 24 proceeds to a process of executing step S3.

Next, the controller 24 closes the expansion device 41 so that no refrigerant flows into the heat medium heat exchanger 61 (step S3). Closing the expansion device 41 means making the opening degree of the expansion device 41 a totally-closed or almost totally-open opening degree. By preventing refrigerant from flowing into the heat medium heat exchanger 61, the air-conditioning apparatus 100 reduces the condensation of refrigerant inside the heat medium heat exchanger 61 to make it easy for gas refrigerant to return to the accumulator 13. Having performed the process of step S3, the controller 24 proceeds to a process of executing step S4.

Next, the controller 24 brings the compressor 10 into operation (step S4). That is, the controller 24 brings the compressor 10 into operation after, at the start of heating operation, bringing at least one or more bypass opening and closing devices into an open state. Bringing the compressor 10 into operation based on the processes from step S1 to step S4 causes high-temperature and high-pressure gas refrigerant discharged from the compressor 10 to pass through any one or more of the first bypass pipe 30, the second bypass pipe 32, and the third bypass pipe 42. Then, the high-temperature and high-pressure gas refrigerant discharged from the compressor 10 passes through a bypass opening and closing device such as the first bypass opening and closing device 31, the second bypass opening and closing device 33, or the third bypass opening and closing device 43 to flow into the accumulator 13. The high-temperature and high-pressure gas refrigerant discharged from the compressor 10 is decompressed into low-pressure refrigerant while passing through the bypass opening and closing device such as the first bypass opening and closing device 31. Then, since refrigerant drops in temperature when decompressed, the refrigerant having just passed through the bypass opening and closing device such as the first bypass opening and closing device 31 turns into low-pressure intermediate-temperature refrigerant. This low-pressure intermediate-temperature refrigerant is low-pressure gas refrigerant with a high degree of superheat that is capable of evaporating the refrigerant contained in the accumulator 13. The air-conditioning apparatus 100 allows the gas refrigerant with a high degree of superheat discharged from the compressor 10 to bypass the heat source side heat exchanger 12 or the heat medium heat exchanger 61 and flow directly into the accumulator 13. As a result, by causing the low-pressure gas refrigerant with a high degree of superheat to flow into the accumulator 13, the air-conditioning apparatus 100 can raise the system pressure of the refrigeration cycle by heating, evaporating, and thereby gasifying the liquid refrigerant accumulated in the accumulator 13. Having performed the process of step S4, the controller 24 proceeds to a determination process of step S5.

Next, the controller 24 determines whether a detected value P1 of the first pressure detection device 20 is greater than or equal to the set value Pa, which is an arbitrary set value, and determines whether a detected value P2 of the second pressure detection device 21 is greater than or equal to the set value Pb, which is an arbitrary set value. Then, the controller 24 determines whether either the condition that the detected value P1 of the first pressure detection device 20 is greater than or equal to the set value Pa or the condition that the detected value P2 of the second pressure detection device 21 is greater than or equal to the set value Pb is met (step S5). In a case in which the controller 24 has determined that either of the conditions is met (YES in step S5), the controller 24 determines that the liquid refrigerant has been successfully purged from the accumulator 13, terminates the heating start-up control function, and shifts to a normal heating operation mode. In a case in which the controller 24 has determined that neither of the conditions is met (NO in step S5), the controller 24 determines that the liquid refrigerant is present in the accumulator 13, and returns to the determination process of step S4.

It should be noted that the method for determining a condition for the termination of the heating start-up control function in step S5 is not limited to the aforementioned method. The termination of the heating start-up control function may be determined by a value that is calculated by the detected value of the first pressure detection device 20 or the detected value of the second pressure detection device 21, for example, the saturation temperature of refrigerant or other values. Alternatively, the termination of the heating start-up control function may be done by providing, at an inflow side of the accumulator 13, a temperature detection device (not illustrated) configured to detect the temperature of refrigerant, calculating a degree of superheat of refrigerant flowing into the accumulator 13, and using the degree of superheat as a value for determination of a termination condition. Alternatively, the controller 24 may use the time-measuring device 27 to terminate the heating start-up control function in a case in which a period of time elapsed after the start of the heating start-up control function reaches a set period of time. That is, the controller 24 may terminate the start-up control function in a case in which the detected value of at least one or more of the first pressure detection device 20 and the second pressure detection device 21 is less than or equal to a threshold or a case in which the period of time elapsed after the start of the start-up control function reaches the set period of time.

FIG. 6 is a flow chart showing another example of operation of the cooling start-up control function and the heating start-up control function of the air-conditioning apparatus 100 according to Embodiment 1. The air-conditioning apparatus 100 may carry out the heating start-up control function in a case in which the detected value of the first pressure detection device 20 or the second pressure detection device 21 is less than or equal to the set value. Accordingly, in starting the air-conditioning operation of the air-conditioning apparatus 100, the controller 24 can carry out the start-up control function based on the detected value of at least one or more of the outdoor temperature detection device 23, the first pressure detection device 20, and the second pressure detection device 21. In this case, the controller 24 carries out the heating start-up control function if any one of the condition that the detected value P1 of the first pressure detection device 20 is less than or equal to a set value Pf, the condition that the detected value P2 of the second pressure detection device 21 is less than or equal to a set value Pg, and the condition that the detected temperature Tout of the outdoor temperature detection device 23 is less than or equal to the set value Ta is met in step S1. Further, although the condition for the start of the heating start-up control function shown in FIG. 5 begins at the start of heating operation, a condition for the start of a heating start-up control function does not need to begin at the start of heating operation. For example, even in a state in which the air-conditioning apparatus 100 is under suspension, the air-conditioning apparatus 100 may carry out the heating start-up control function at regular time intervals. While the air-conditioning apparatus 100 is under suspension, the controller 24 can carry out the start-up control function based on the detected value of at least one or more of the outdoor temperature detection device 23, the first pressure detection device 20, and the second pressure detection device 21 at set time intervals. In this case, the controller 24 carries out the heating start-up control function in a case in which the detected value is less than or equal to the set value. That is, the controller 24 carries out the heating start-up control function if any one of the condition that the detected value P1 of the first pressure detection device 20 is less than or equal to the set value Pf, the condition that the detected value P2 of the second pressure detection device 21 is less than or equal to the set value Pg, and the condition that the detected temperature Tout of the outdoor temperature detection device 23 is less than or equal to the set value Ta is met in step S1. Since the air-conditioning apparatus 100 can prevent accumulation of refrigerant in the accumulator 13 by executing the heating start-up control function, the air-conditioning apparatus 100 can prevent deterioration of the heating capacity at the start of cooling operation under low outside air temperature conditions.

By carrying out the heating start-up control function, the air-conditioning apparatus 100 can efficiently gasify the liquid refrigerant accumulated in the accumulator 13. Therefore, at the start of heating operation under low outside air temperature conditions, the air-conditioning apparatus 100 can reduce deterioration of the heating capacity due to a decrease in system pressure in a case in which a large amount of refrigerant is accumulated in the accumulator 13.

[Working Effects of Air-Conditioning Apparatus 100]

The air-conditioning apparatus 100 includes a controller 24 configured to control the bypass opening and closing device to carry out a start-up control function of causing low-pressure gas refrigerant with a high degree of superheat to flow into the accumulator 13. Therefore, even under low outdoor temperature operating conditions, the air-conditioning apparatus 100 can circulate refrigerant through the inside of the refrigerant circuit 101 by gasifying liquid refrigerant accumulated in the accumulator 13. As a result, even under low outdoor temperature operating conditions, the air-conditioning apparatus 100 can reduce deterioration of capacity due to freezing of the heat medium during cooling operation or due to formation of frost on the heat source side heat exchanger 12 during heating operation.

Further, the controller 24 of the air-conditioning apparatus 100 exercises control so that the compressor 10 is activated after the pump 62 and the heat medium flow control device 63 have been activated. When the pump 62 and the heat medium flow control device 63 are operated before the start of the operation of the compressor 10 so that the heat medium circulates through the inside of the heat medium circuit 102, the air-conditioning apparatus 100 makes it hard for the heat medium to freeze in the heat medium heat exchanger 61.

Embodiment 2

[Air-Conditioning Apparatus 100A]

Figure 7:
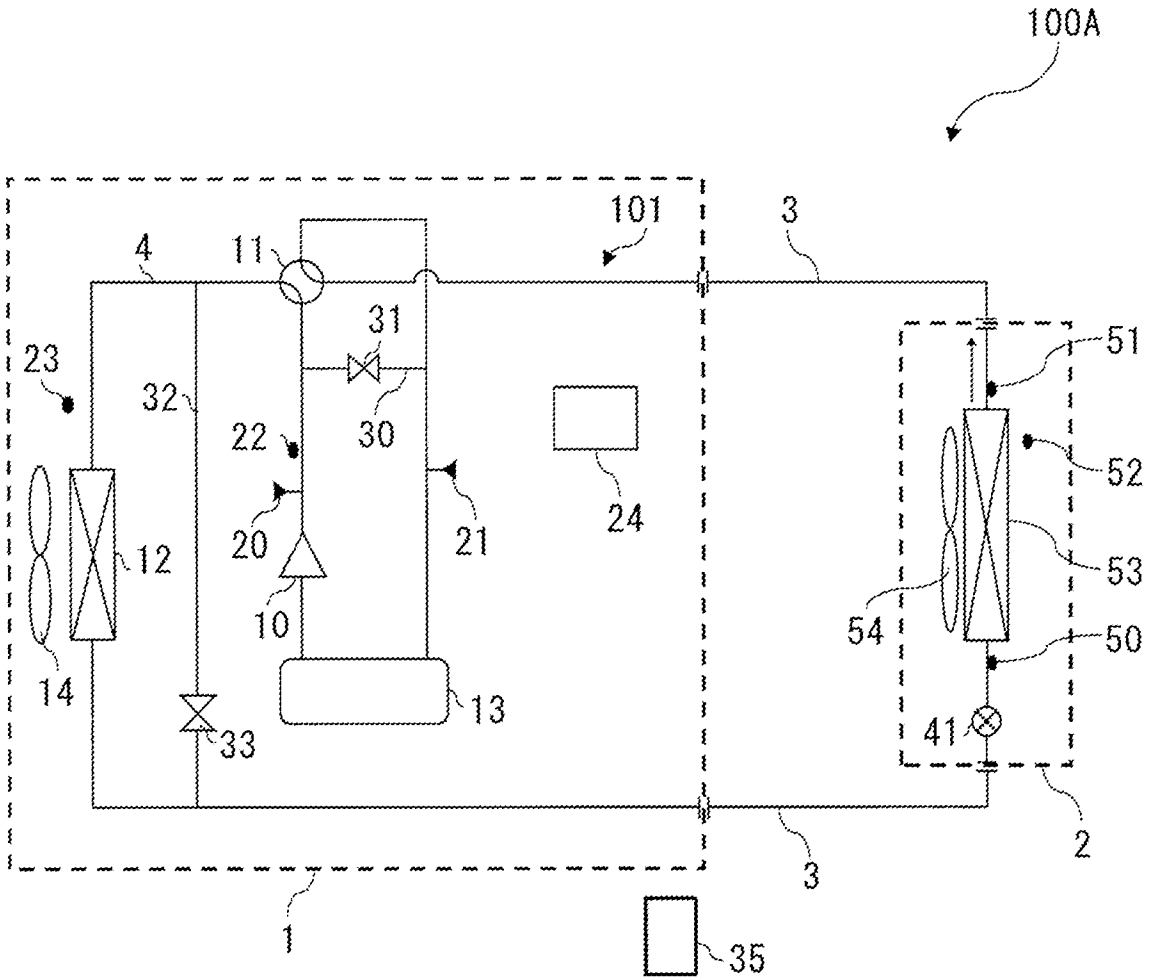
FIG. 7 is a schematic circuit configuration diagram showing an example of a circuit configuration of an air-conditioning apparatus according to Embodiment 2.

FIG. 7 is a schematic circuit configuration diagram showing an example of a circuit configuration of an air-conditioning apparatus 100A according to Embodiment 2. The air-conditioning apparatus 100A according to Embodiment 2 differs from the air-conditioning apparatus 100 according to Embodiment 1 in that the secondary loop configuration of the refrigerant circuit 101 and the heat medium circuit 102 is replaced by a primary loop circuit constituted by the refrigerant circuit 101 alone. Items of the air-conditioning apparatus 100A according to Embodiment 2 that are not specified are similar to those of the air-conditioning apparatus 100 according to Embodiment 1, and identical functions and components are described with reference to identical reference signs.

The air-conditioning apparatus 100A shown in FIG. 7 illustrates an example in which one indoor unit 2 is connected to the outdoor unit 1. However, the air-conditioning apparatus 100A may be configured such that the number of indoor units 2 that are connected to one outdoor unit 1 is not limited to 1 and a plurality of indoor units 2 may be connected to the outdoor unit 1. That is, the air-conditioning apparatus 100A may be configured to include a plurality of indoor units 2.

[Cooling Operation Mode]

Figure 8:
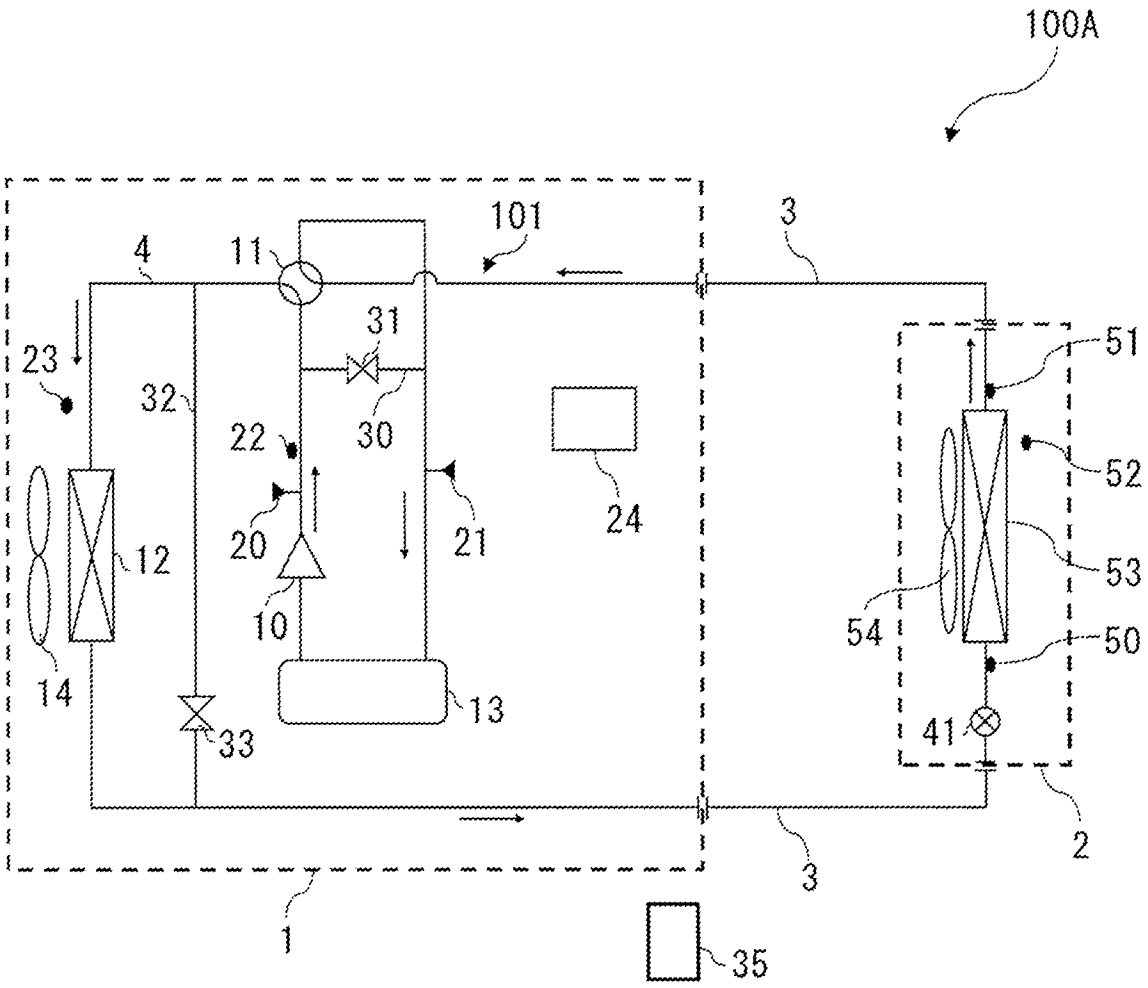
FIG. 8 is a circuit diagram showing the flow of refrigerant during a cooling operation mode of the air-conditioning apparatus according to Embodiment 2.

FIG. 8 is a circuit diagram showing the flow of refrigerant during a cooling operation mode of the air-conditioning apparatus 100A according to Embodiment 2. As shown in FIG. 8, the directions of flow of refrigerant are indicated by arrows. With reference to FIG. 8, the cooling operation mode is described by taking as an example a case in which a cooling load is generated in the load side heat exchanger 53.

In the case of the cooling operation mode, low-temperature and low-pressure refrigerant is compressed by the compressor 10 and discharged as high-temperature and high-pressure gas refrigerant. The high-temperature and high-pressure refrigerant discharged from the compressor 10 flows into the heat source side heat exchanger 12 via the refrigerant flow switching device 11. The high-temperature and high-pressure gas refrigerant having flowed into the heat source side heat exchanger 12 condenses into high-pressure liquid refrigerant while transferring heat to outdoor air. Then, the high-pressure liquid refrigerant having flowed out of the heat source side heat exchanger 12 flows out of the outdoor unit 1, passes through the refrigerant main pipe 3, and flows into the indoor unit 2.

The high-pressure liquid refrigerant having flowed out of the outdoor unit 1 into the indoor unit 2 is decompressed by the expansion device 41 into low-temperature and low-pressure two-phase refrigerant that then flows into the load side heat exchanger 53, which functions as an evaporator, cools the refrigerant by removing heat from the indoor air, and turns into low-temperature and low-pressure gas refrigerant. The low-temperature and low-pressure gas refrigerant having flowed out of the load side heat exchanger 53 flows out of the indoor unit 2, passes through the refrigerant main pipe 3, and flows into the outdoor unit 1. The refrigerant having flowed from the indoor unit 2 into the outdoor unit 1 passes through the refrigerant flow switching device 11 and the accumulator 13 and is suctioned into the compressor 10.

Meanwhile, the controller 24 brings the first bypass opening and closing device 31 and the second bypass opening and closing device 33 into a closed state so that the outdoor unit 1 of the air-conditioning apparatus 100A prevents the refrigerant from bypassing inside the outdoor unit 1. In a case in which the first bypass opening and closing device 31 and the second bypass opening and closing device 33 are devices, such as solenoid valves, whose opening degrees are not adjustable, the controller 24 exercises control so that the first bypass opening and closing device 31 and the second bypass opening and closing device 33 are in a closed state during the cooling operation mode. Alternatively, in a case in which the first bypass opening and closing device 31 is a device, such as an electronic expansion valve, whose opening area is adjustable, the controller 24 may set the opening degree of the valve of the first bypass opening and closing device 31 during the cooling operation mode to such an opening degree that the operational state of the refrigeration cycle is not adversely affected. Similarly, in a case in which the second bypass opening and closing device 33 is a device, such as an electronic expansion valve, whose opening area is adjustable, the controller 24 may set the opening degree of the valve of the second bypass opening and closing device 33 during the cooling operation mode to such an opening degree that the operational state of the refrigeration cycle is not adversely affected. The clause "the operational state of the refrigeration cycle is not adversely affected" means, for example, that the cooling capacity is not adversely affected, and the phrase "such an opening degree that . . . is not adversely affected" is for example a totally-closed or almost totally-closed opening degree.

Further, the compressor 10 may be controlled by the controller 24 so that the detected value of the first pressure detection device 20 or the second pressure detection device 21 becomes a predetermined value. Alternatively, the compressor 10 may be controlled by the controller 24 so that the detected values of the first pressure detection device 20 and the second pressure detection device 21 become predetermined values. For example, when, in a case in which the air-conditioning apparatus 100A is in the cooling operation mode, the controller 24 controls the compressor 10 so that an evaporating temperature that can be calculated from the detected value of the second pressure detection device 21 takes on a predetermined value, the compressor 10 can supply refrigerant at a flow rate appropriate to a cooling load needed in the indoor unit 2.

The outdoor air-sending device 14 may be controlled by the controller 24 so that the detected value of the first pressure detection device 20 or the second pressure detection device 21 becomes a predetermined value. Alternatively, the outdoor air-sending device 14 may be controlled by the controller 24 so that the detected values of the first pressure detection device 20 and the second pressure detection device 21 become predetermined values. For example, in a case in which the air-conditioning apparatus 100A is in the cooling operation mode, the controller 24 may control the outdoor air-sending device 14 so that a condensing temperature that can be calculated from the detected value of the first pressure detection device 20 takes on a predetermined value.

The expansion device 41 may have its opening degree controlled by the controller 24 so that the degree of superheat at an outlet of the load side heat exchanger 53 becomes constant.

[Heating Operation Mode]

Figure 9:
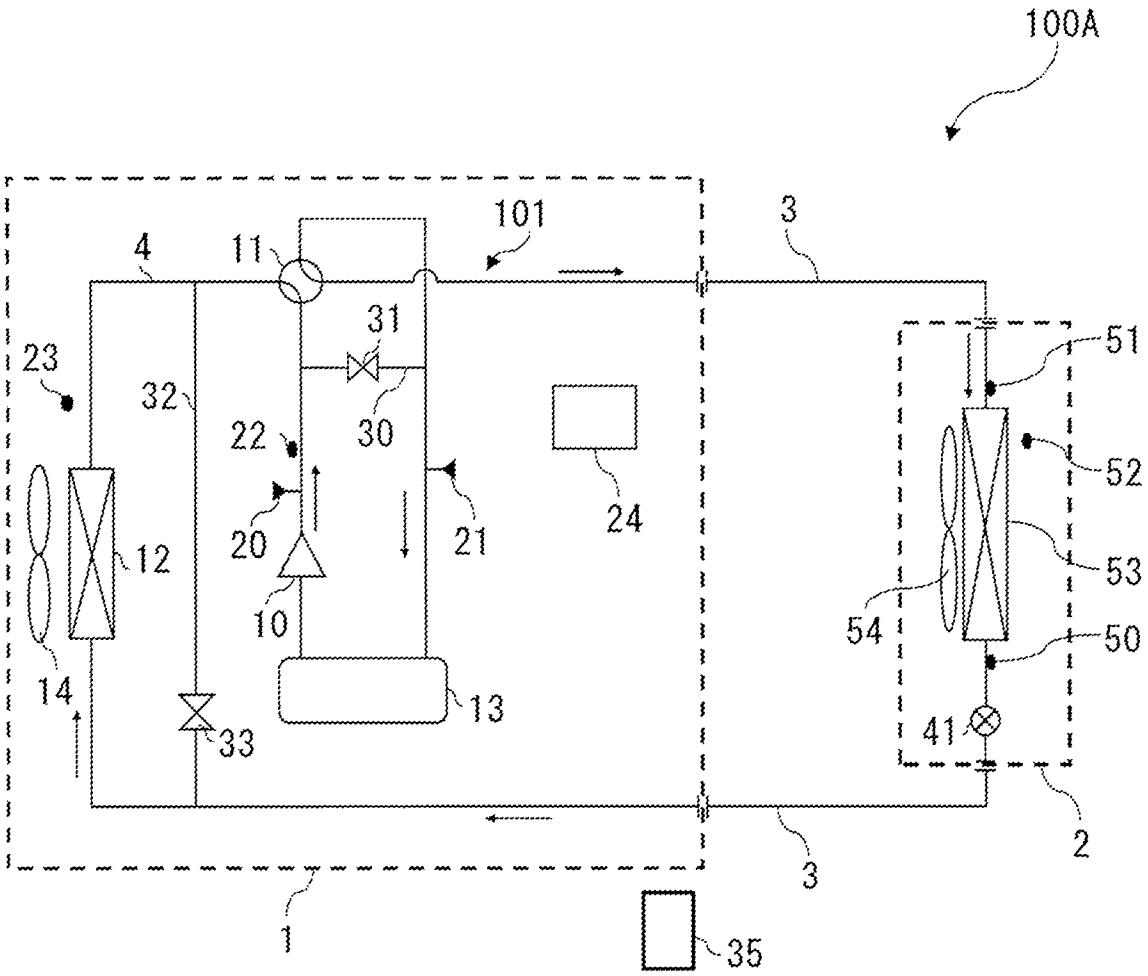
FIG. 9 is a circuit diagram showing the flow of refrigerant during a heating operation mode of the air-conditioning apparatus according to Embodiment 2.

FIG. 9 is a circuit diagram showing the flow of refrigerant during a heating operation mode of the air-conditioning apparatus 100A according to Embodiment 2. As shown in FIG. 9, the directions of flow of refrigerant are indicated by arrows. With reference to FIG. 9, the heating operation mode is described by taking as an example a case in which a heating load is generated in the load side heat exchanger 53.

In the case of the heating operation mode, low-temperature and low-pressure refrigerant is compressed by the compressor 10 and discharged as high-temperature and high-pressure gas refrigerant. The high-temperature and high-pressure refrigerant discharged from the compressor 10 flows out of the outdoor unit 1 via the refrigerant flow switching device 11, passes through the refrigerant main pipe 3, and flows into the indoor unit 2. The high-temperature and high-pressure gas refrigerant having flowed into the indoor unit 2 flows into the load side heat exchanger 53 and condenses into high-pressure liquid refrigerant while transferring heat to the indoor air in the load side heat exchanger 53. The high-pressure liquid refrigerant having flowed out of the load side heat exchanger 53 flows into the expansion device 41. Then, the high-pressure liquid refrigerant having flowed into the expansion device 41 is decompressed by the expansion device 41 into low-temperature and low-pressure two-phase gas-liquid refrigerant that then flows out of the indoor unit 2, passes through the refrigerant main pipe 3, and flows into the outdoor unit 1.

The low-temperature and low-pressure two-phase gas-liquid refrigerant having flowed into the outdoor unit 1 flows into the heat source side heat exchanger 12, which functions as an evaporator, and evaporates into low-temperature and low-pressure gas refrigerant by receiving heat from air. The low-temperature and low-pressure gas refrigerant having flowed out of the heat source side heat exchanger 12 passes through the refrigerant flow switching device 11 and the accumulator 13 and is suctioned into the compressor 10.

Meanwhile, the controller 24 brings the first bypass opening and closing device 31 and the second bypass opening and closing device 33 into a closed state so that the outdoor unit 1 of the air-conditioning apparatus 100A prevents the refrigerant from bypassing inside the outdoor unit 1. In a case in which the first bypass opening and closing device 31 and the second bypass opening and closing device 33 are devices, such as solenoid valves, whose opening degrees are not adjustable, the controller 24 exercises control so that the first bypass opening and closing device 31 and the second bypass opening and closing device 33 are in a closed state during the heating operation mode. Alternatively, in a case in which the first bypass opening and closing device 31 is a device, such as an electronic expansion valve, whose opening area is adjustable, the controller 24 may set the opening degree of the valve of the first bypass opening and closing device 31 during the heating operation mode to such an opening degree that the operational state of the refrigeration cycle is not adversely affected. Similarly, in a case in which the second bypass opening and closing device 33 is a device, such as an electronic expansion valve, whose opening area is adjustable, the controller 24 may set the opening degree of the valve of the second bypass opening and closing device 33 during the heating operation mode to such an opening degree that the operational state of the refrigeration cycle is not adversely affected. The clause "the operational state of the refrigeration cycle is not adversely affected" means, for example, that the heating capacity is not adversely affected, and the phrase "such an opening degree that . . . is not adversely affected" is for example a totally-closed or almost totally-closed opening degree.

Further, the compressor 10 may be controlled by the controller 24 so that the detected value of the first pressure detection device 20 or the second pressure detection device 21 becomes a predetermined value. Alternatively, the compressor 10 may be controlled by the controller 24 so that the detected values of the first pressure detection device 20 and the second pressure detection device 21 become predetermined values. For example, when, in a case in which the air-conditioning apparatus 100A is in the heating operation mode, the controller 24 controls the compressor 10 so that a condensing temperature that can be calculated from the detected value of the first pressure detection device 20 takes on a predetermined value, the compressor 10 can supply refrigerant at a flow rate appropriate to a heating load needed in the indoor unit 2.

The outdoor air-sending device 14 may be controlled by the controller 24 so that the detected value of the first pressure detection device 20 or the second pressure detection device 21 becomes a predetermined value. Alternatively, the outdoor air-sending device 14 may be controlled by the controller 24 so that the detected values of the first pressure detection device 20 and the second pressure detection device 21 become predetermined values. For example, in a case in which the air-conditioning apparatus 100A is in the heating operation mode, the controller 24 may control the outdoor air-sending device 14 so that an evaporating temperature that can be calculated from the detected value of the second pressure detection device 21 takes on a predetermined value.

The expansion device 41 may have its opening degree controlled by the controller 24 so that the degree of subcooling at the outlet of the load side heat exchanger 53 becomes constant.

[Cooling Start-Up Control Function During Cooling Operation Mode]

Figure 10:
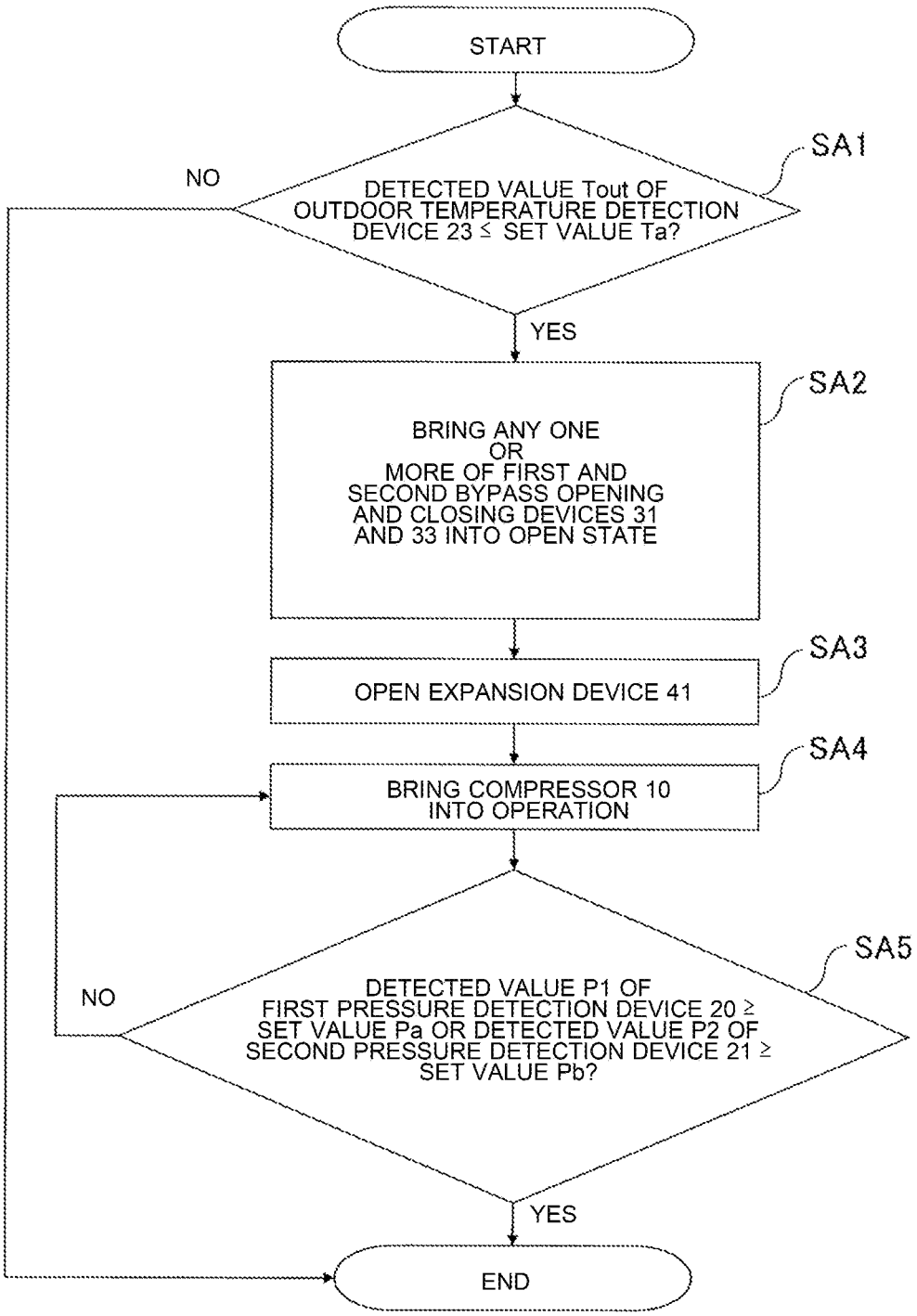
FIG. 10 is a flow chart showing operation of a cooling start-up control function and a heating start-up control function of the air-conditioning apparatus according to Embodiment 2.

FIG. 10 is a flow chart showing operation of a cooling start-up control function and a heating start-up control function of the air-conditioning apparatus 100A according to Embodiment 2. The following describes, with reference to FIG. 10, the cooling start-up control function of, at the start of cooling operation under low outside air temperature conditions, purging refrigerant accumulated in the accumulator 13 of the air-conditioning apparatus 100A according to Embodiment 2.

FIG. 10 is a flow chart representing operation of the cooling start-up control function during a cooling operation mode of the air-conditioning apparatus 100A. When the remote controller 35 is operated by a user and cooling operation gets started, the air-conditioning apparatus 100A starts the cooling start-up control function and performs an operation according to the flow chart shown in FIG. 10. As for various devices in the air-conditioning apparatus 100A whose actions are not defined in the flow chart shown in FIG. 10, actions are performed according to the aforementioned cooling operation mode.

First, the controller 24 determines whether a detected temperature Tout of the outdoor temperature detection device 23 is less than or equal to a set value Ta, which is an arbitrary set value (step SA1). The set value Ta may be set, for example, to 5 degrees Celsius, as liquid refrigerant is more easily accumulated in the accumulator 13 at lower outdoor temperatures. In a case in which the controller 24 has determined that the detected temperature Tout of the outdoor temperature detection device 23 is greater than the set value Ta (NO in step SA1), the controller 24 performs the operation of the aforementioned cooling operation mode without carrying out the cooling start-up control function. In a case in which the controller 24 has determined that the detected temperature Tout of the outdoor temperature detection device 23 is less than or equal to the set value Ta (YES in step SA1), the controller 24 determines that liquid refrigerant is present in the accumulator 13, and proceeds to a process of executing step SA2.

Next, the controller 24 brings either one or more of the first bypass opening and closing device 31 and the second bypass opening and closing device 33 into an open state (step SA2). In step SA2, although the controller 24 is supposed to open either one of the two bypass opening and closing devices, the more bypass opening and closing devices are opened, the earlier the air-conditioning apparatus 100A can gasify the liquid refrigerant contained in the accumulator 13. Having performed the process of step SA2, the controller 24 proceeds to a process of executing step SA3.

Next, the controller 24 brings the opening degree of the expansion device 41 into an open state (step SA3). In so doing, making the opening degree of the expansion device 41 a totally-open or almost totally-open opening degree results in a reduced pressure loss in the expansion device 41. Therefore, the air-conditioning apparatus 100A can raise the pressure and temperature of refrigerant flowing into the load side heat exchanger 53, making it easy for gas refrigerant to return to the accumulator 13. Having performed the process of step SA3, the controller 24 proceeds to a process of executing step SA4.

Next, the controller 24 brings the compressor 10 into operation (step SA4). That is, the controller 24 brings the compressor 10 into operation after, at the start of cooling operation, bringing at least one or more bypass opening and closing devices into an open state. Bringing the compressor 10 into operation based on the processes from step SA1 to step SA4 causes high-temperature and high-pressure gas refrigerant discharged from the compressor 10 to pass through either one or more of the first bypass pipe 30 and the second bypass pipe 32. Then, the high-temperature and high-pressure gas refrigerant discharged from the compressor 10 passes through a bypass opening and closing device such as the first bypass opening and closing device 31 or the second bypass opening and closing device 33 to flow into the accumulator 13. The high-temperature and high-pressure gas refrigerant discharged from the compressor 10 is decompressed into low-pressure refrigerant while passing through the bypass opening and closing device such as the first bypass opening and closing device 31. Then, since refrigerant drops in temperature when decompressed, the refrigerant having just passed through the bypass opening and closing device such as the first bypass opening and closing device 31 turns into low-pressure intermediate-temperature refrigerant. This low-pressure intermediate-temperature refrigerant is low-pressure gas refrigerant with a high degree of superheat that is capable of evaporating the refrigerant contained in the accumulator 13. The air-conditioning apparatus 100A allows the gas refrigerant with a high degree of superheat discharged from the compressor 10 to bypass the heat source side heat exchanger 12 or the load side heat exchanger 53 and flow directly into the accumulator 13. As a result, by causing the low-pressure gas refrigerant with a high degree of superheat to flow into the accumulator 13, the air-conditioning apparatus 100A can raise the system pressure of the refrigeration cycle by heating, evaporating, and thereby gasifying the liquid refrigerant accumulated in the accumulator 13. Having performed the process of step SA4, the controller 24 proceeds to a determination process of step SA5.

In step SA4, the controller 24 may exercise control so that the indoor air-sending device 54 stops or the rotation speed of the air-sending device 54 decreases. When the controller 24 exercises control so that the indoor air-sending device 54 stops or the rotation speed of the air-sending device 54 decreases, the air-conditioning apparatus 100A can reduce the amount of refrigerant that condenses in the load side heat exchanger 53. As a result, the air-conditioning apparatus 100A can efficiently gasify the refrigerant accumulated in the accumulator 13.

Next, the controller 24 determines whether a detected value P1 of the first pressure detection device 20 is greater than or equal to the set value Pa, which is an arbitrary set value, and determines whether a detected value P2 of the second pressure detection device 21 is greater than or equal to the set value Pb, which is an arbitrary set value. Then, the controller 24 determines whether either the condition that the detected value P1 of the first pressure detection device 20 is greater than or equal to the set value Pa or the condition that the detected value P2 of the second pressure detection device 21 is greater than or equal to the set value Pb is met (step SA5). In a case in which the controller 24 has determined that either of the conditions is met (YES in step SA5), the controller 24 determines that the liquid refrigerant has been successfully purged from the accumulator 13, terminates the cooling start-up control function, and shifts to a normal cooling operation mode. In a case in which the controller 24 has determined that neither of the conditions is met (NO in step SA5), the controller 24 determines that the liquid refrigerant is present in the accumulator 13, and returns to the determination process of step SA4.

It should be noted that the method for determining a condition for the termination of the cooling start-up control function in step SA5 is not limited to the aforementioned method. The termination of the cooling start-up control function may be determined by a value that is calculated by the detected value of the first pressure detection device 20 or the detected value of the second pressure detection device 21, for example, the saturation temperature of refrigerant or other values. Alternatively, the termination of the cooling start-up control function may be done by providing, at an inflow side of the accumulator 13, a temperature detection device (not illustrated) configured to detect the temperature of refrigerant, calculating a degree of superheat of refrigerant flowing into the accumulator 13, and using the degree of superheat as a value for determination of a termination condition. Alternatively, the controller 24 may use the time-measuring device 27 to terminate the cooling start-up control function in a case in which a period of time elapsed after the start of the cooling start-up control function reaches a set period of time. That is, the controller 24 may terminate the start-up control function in a case in which the detected value of at least one or more of the first pressure detection device 20 and the second pressure detection device 21 is less than or equal to a threshold or a case in which the period of time elapsed after the start of the start-up control function reaches the set period of time.

As shown in FIG. 6, the air-conditioning apparatus 100A may carry out the cooling start-up control function in a case in which the detected value of the first pressure detection device 20 or the second pressure detection device 21 is less than or equal to the set value. Accordingly, in starting the air-conditioning operation of the air-conditioning apparatus 100A, the controller 24 can carry out the start-up control function based on the detected value of at least one or more of the outdoor temperature detection device 23, the first pressure detection device 20, and the second pressure detection device 21. In this case, the controller 24 carries out the cooling start-up control function if any one of the condition that the detected value P1 of the first pressure detection device 20 is less than or equal to a set value Pf, the condition that the detected value P2 of the second pressure detection device 21 is less than or equal to a set value Pg, and the condition that the detected temperature Tout of the outdoor temperature detection device 23 is less than or equal to the set value Ta is met in step SA1. Further, although the condition for the start of the cooling start-up control function shown in FIG. 10 begins at the start of cooling operation, a condition for the start of a cooling start-up control function does not need to begin at the start of cooling operation. For example, even in a state in which the air-conditioning apparatus 100A is under suspension, the air-conditioning apparatus 100A may carry out the cooling start-up control function at regular time intervals. While the air-conditioning apparatus 100A is under suspension, the controller 24 can carry out the start-up control function based on the detected value of at least one or more of the outdoor temperature detection device 23, the first pressure detection device 20, and the second pressure detection device 21 at set time intervals. In this case, the controller 24 carries out the cooling start-up control function in a case in which the detected value is less than or equal to the set value. That is, the controller 24 carries out the cooling start-up control function if any one of the condition that the detected value P1 of the first pressure detection device 20 is less than or equal to the set value Pf, the condition that the detected value P2 of the second pressure detection device 21 is less than or equal to the set value Pg, and the condition that the detected temperature Tout of the outdoor temperature detection device 23 is less than or equal to the set value Ta is met in step SA1. Since the air-conditioning apparatus 100A can prevent accumulation of refrigerant in the accumulator 13 by executing the cooling start-up control function, the air-conditioning apparatus 100A can prevent the heat medium from freezing at the start of cooling operation under low outside air temperature conditions.

By carrying out the cooling start-up control function, the air-conditioning apparatus 100A can efficiently gasify the liquid refrigerant accumulated in the accumulator 13. At the start of cooling operation under low outside air temperature conditions, the air-conditioning apparatus 100A can improve deterioration of the cooling capacity due to formation of frost on the load side heat exchanger 53 due to a decrease in system pressure due to accumulation of a large amount of refrigerant in the accumulator 13.

[Heating Start-Up Control Function During Heating Operation Mode]

The following describes, with reference to FIG. 10, the heating start-up control function of, at the start of heating operation under low outside air temperature conditions, purging refrigerant accumulated in the accumulator 13 of the air-conditioning apparatus 100A according to Embodiment 2.

FIG. 10 is also a flow chart representing operation of the heating start-up control function during the heating operation mode. When the remote controller 35 is operated by a user and heating operation gets started, the air-conditioning apparatus 100A starts the heating start-up control function and performs an operation according to the flow chart shown in FIG. 10. As for various devices in the air-conditioning apparatus 100A whose actions are not defined in the flow chart shown in FIG. 10, actions are performed according to the aforementioned heating operation mode.

First, the controller 24 determines whether a detected temperature Tout of the outdoor temperature detection device 23 is less than or equal to a set value Ta, which is an arbitrary set value (step SA1). The set value Ta may be set, for example, to 5 degrees Celsius, as refrigerant is more easily accumulated in the accumulator 13 at lower outdoor temperatures. In a case in which the controller 24 has determined that the detected temperature Tout of the outdoor temperature detection device 23 is greater than the set value Ta (NO in step SA1), the controller 24 performs the operation of the aforementioned heating operation mode without carrying out the heating start-up control function. In a case in which the controller 24 has determined that the detected temperature Tout of the outdoor temperature detection device 23 is less than or equal to the set value Ta (YES in step SA1), the controller 24 determines that liquid refrigerant is present in the accumulator 13, and proceeds to a process of executing SA2.

Next, the controller 24 brings either one or more of the first bypass opening and closing device 31 and the second bypass opening and closing device 33 into an open state (step SA2). In step SA2, although the controller 24 is supposed to open either one of the two bypass opening and closing devices, the more bypass opening and closing devices are opened, the earlier the air-conditioning apparatus 100A can gasify the liquid refrigerant contained in the accumulator 13. Having performed the process of step SA2, the controller 24 proceeds to a process of executing step SA3.

Next, the controller 24 brings the opening degree of the expansion device 41 into an open state (step SA3). In so doing, making the opening degree of the expansion device 41 a totally-open or almost totally-open opening degree results in a reduced pressure loss in the expansion device 41. Therefore, the air-conditioning apparatus 100A can raise the pressure and temperature of refrigerant flowing into the load side heat exchanger 53, making it hard for refrigerant flowing through the load side heat exchanger 53 to condense and thereby making it easy for gas refrigerant to return to the accumulator 13. Having performed the process of step SA3, the controller 24 proceeds to a process of executing step SA4.

Next, the controller 24 brings the compressor 10 into operation (step SA4). That is, the controller 24 brings the compressor 10 into operation after, at the start of heating operation, bringing at least one or more bypass opening and closing devices into an open state. Bringing the compressor 10 into operation based on the processes from step SA1 to step SA4 causes high-temperature and high-pressure gas refrigerant discharged from the compressor 10 to pass through either one or more of the first bypass pipe 30 and the second bypass pipe 32. Then, the high-temperature and high-pressure gas refrigerant discharged from the compressor 10 passes through a bypass opening and closing device such as the first bypass opening and closing device 31 or the second bypass opening and closing device 33 to flow into the accumulator 13. The high-temperature and high-pressure gas refrigerant discharged from the compressor 10 is decompressed into low-pressure refrigerant while passing through the bypass opening and closing device such as the first bypass opening and closing device 31. Then, since refrigerant drops in temperature when decompressed, the refrigerant having just passed through the bypass opening and closing device such as the first bypass opening and closing device 31 turns into low-pressure intermediate-temperature refrigerant. This low-pressure intermediate-temperature refrigerant is low-pressure gas refrigerant with a high degree of superheat that is capable of evaporating the refrigerant contained in the accumulator 13. The air-conditioning apparatus 100A allows the gas refrigerant with a high degree of superheat discharged from the compressor 10 to bypass the heat source side heat exchanger 12 or the load side heat exchanger 53 and flow directly into the accumulator 13. As a result, by causing the low-pressure gas refrigerant with a high degree of superheat to flow into the accumulator 13, the air-conditioning apparatus 100A can raise the system pressure of the refrigeration cycle by heating, evaporating, and thereby gasifying the liquid refrigerant accumulated in the accumulator 13. Having performed the process of step SA4, the controller 24 proceeds to a determination process of step SA5.

Next, the controller 24 determines whether a detected value P1 of the first pressure detection device 20 is greater than or equal to the set value Pa, which is an arbitrary set value, and determines whether a detected value P2 of the second pressure detection device 21 is greater than or equal to the set value Pb, which is an arbitrary set value. Then, the controller 24 determines whether either the condition that the detected value P1 of the first pressure detection device 20 is greater than or equal to the set value Pa or the condition that the detected value P2 of the second pressure detection device 21 is greater than or equal to the set value Pb is met (step SA5). In a case in which the controller 24 has determined that either of the conditions is met (YES in step SA5), the controller 24 determines that the liquid refrigerant has been successfully purged from the accumulator 13, terminates the heating start-up control function, and shifts to a normal heating operation mode. In a case in which the controller 24 has determined that neither of the conditions is met (NO in step SA5), the controller 24 determines that the liquid refrigerant is present in the accumulator 13, and returns to the determination process of step SA4.

It should be noted that the method for determining a condition for the termination of the heating start-up control function in step SA5 is not limited to the aforementioned method. The termination of the heating start-up control function may be determined by a value that is calculated by the detected value of the first pressure detection device 20 or the detected value of the second pressure detection device 21, for example, the saturation temperature of refrigerant or other values. Alternatively, the termination of the heating start-up control function may be done by providing, at an inflow side of the accumulator 13, a temperature detection device (not illustrated) configured to detect the temperature of refrigerant, calculating a degree of superheat of refrigerant flowing into the accumulator 13, and using the degree of superheat as a value for determination of a termination condition. Alternatively, the controller 24 may use the time-measuring device 27 to terminate the heating start-up control function in a case in which a period of time elapsed after the start of the heating start-up control function reaches a set period of time. That is, the controller 24 may terminate the start-up control function in a case in which the detected value of at least one or more of the first pressure detection device 20 and the second pressure detection device 21 is less than or equal to a threshold or a case in which the period of time elapsed after the start of the start-up control function reaches the set period of time.

As shown in FIG. 6, the air-conditioning apparatus 100A may carry out the heating start-up control function in a case in which the detected value of the first pressure detection device 20 or the second pressure detection device 21 is less than or equal to the set value. Accordingly, in starting the air-conditioning operation of the air-conditioning apparatus 100A, the controller 24 can carry out the start-up control function based on the detected value of at least one or more of the outdoor temperature detection device 23, the first pressure detection device 20, and the second pressure detection device 21. In this case, the controller 24 carries out the heating start-up control function if any one of the condition that the detected value P1 of the first pressure detection device 20 is less than or equal to a set value Pf, the condition that the detected value P2 of the second pressure detection device 21 is less than or equal to a set value Pg, and the condition that the detected temperature Tout of the outdoor temperature detection device 23 is less than or equal to the set value Ta is met in step SA1. Further, although the condition for the start of the heating start-up control function shown in FIG. 10 begins at the start of heating operation, a condition for the start of a heating start-up control function does not need to begin at the start of heating operation. For example, even in a state in which the air-conditioning apparatus 100A is under suspension, the air-conditioning apparatus 100A may carry out the heating start-up control function at regular time intervals. While the air-conditioning apparatus 100A is under suspension, the controller 24 can carry out the start-up control function based on the detected value of at least one or more of the outdoor temperature detection device 23, the first pressure detection device 20, and the second pressure detection device 21 at set time intervals. In this case, the controller 24 carries out the heating start-up control function in a case in which the detected value is less than or equal to the set value. That is, the controller 24 carries out the heating start-up control function if any one of the condition that the detected value P1 of the first pressure detection device 20 is less than or equal to the set value Pf, the condition that the detected value P2 of the second pressure detection device 21 is less than or equal to the set value Pg, and the condition that the detected temperature Tout of the outdoor temperature detection device 23 is less than or equal to the set value Ta is met in step SA1. Since the air-conditioning apparatus 100A can prevent accumulation of refrigerant in the accumulator 13 by executing the heating start-up control function, the air-conditioning apparatus 100A can prevent deterioration of the heating capacity at the start of cooling operation under low outside air temperature conditions.

By carrying out the heating start-up control function, the air-conditioning apparatus 100A can efficiently gasify the liquid refrigerant accumulated in the accumulator 13. Therefore, at the start of heating operation under low outside air temperature conditions, the air-conditioning apparatus 100A can reduce deterioration of the heating capacity due to a decrease in system pressure in a case in which a large amount of refrigerant is accumulated in the accumulator 13.

[Working Effects of Air-Conditioning Apparatus 100A]

The air-conditioning apparatus 100A includes a controller 24 configured to control the bypass opening and closing device to carry out a start-up control function of causing low-pressure gas refrigerant with a high degree of superheat to flow into the accumulator 13. Therefore, even under low outdoor temperature operating conditions, the air-conditioning apparatus 100A can circulate refrigerant through the inside of the refrigerant circuit 101 by gasifying liquid refrigerant accumulated in the accumulator 13. As a result, even under low outdoor temperature operating conditions, the air-conditioning apparatus 100A can reduce deterioration of capacity due to freezing of the heat medium during cooling operation o due to formation of frost on the heat source side heat exchanger 12 during heating operation.

Embodiment 3

[Air-Conditioning Apparatus 100B]

Figure 11:
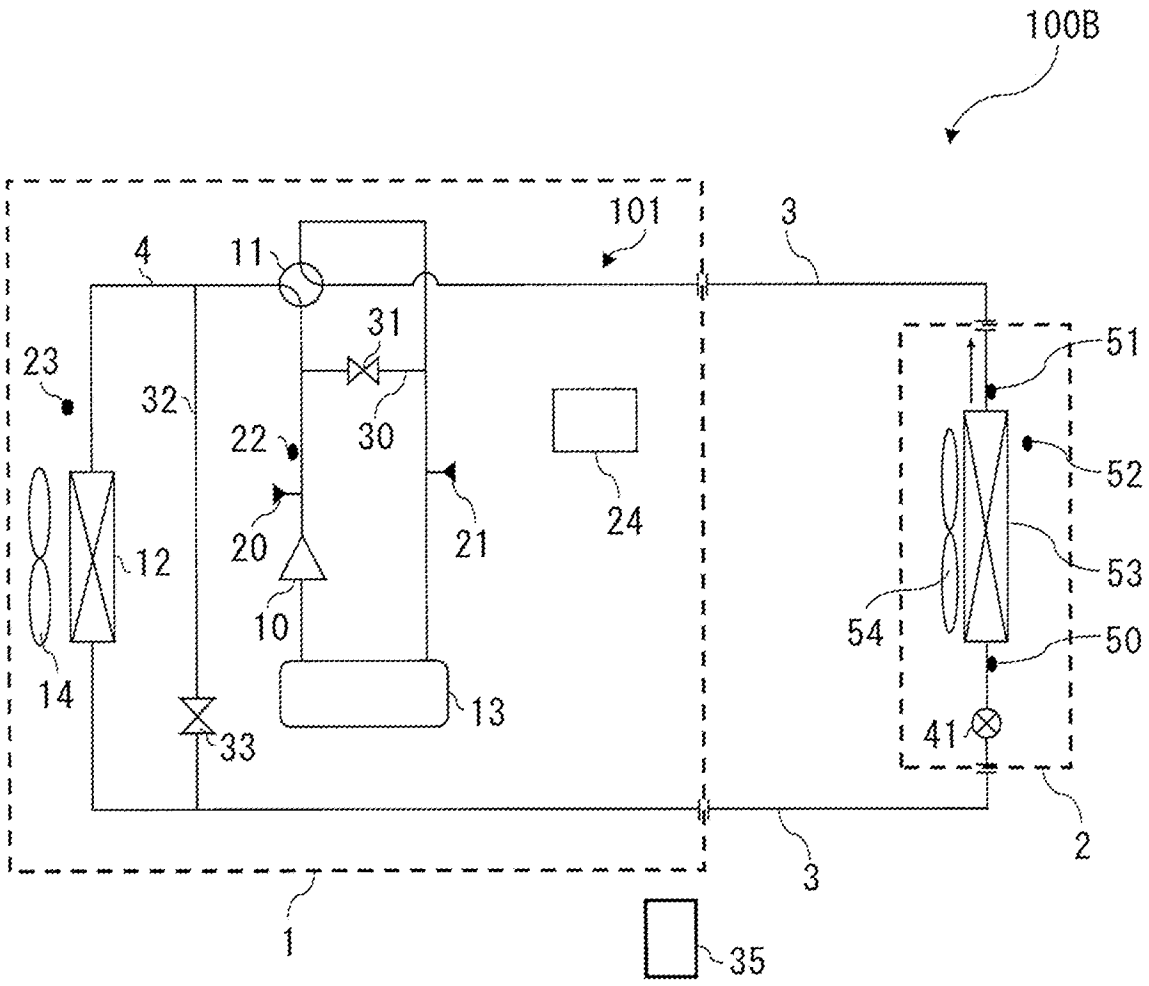
FIG. 11 is a schematic circuit configuration diagram showing an example of a circuit configuration of an air-conditioning apparatus according to Embodiment 3.

FIG. 11 is a schematic circuit configuration diagram showing an example of a circuit configuration of an air-conditioning apparatus 100B according to Embodiment 3. Items of the air-conditioning apparatus 100B according to Embodiment 3 that are not specified are similar to those of the air-conditioning apparatus 100 according to Embodiment 1, and identical functions and components are described with reference to identical reference signs. Further, the circuit configuration of the air-conditioning apparatus 100B according to Embodiment 3 is not described, as it is the same as that of the air-conditioning apparatus 100A according to Embodiment 2. Furthermore, the operation of the cooling operation mode and the heating operation mode of the air-conditioning apparatus 100B according to Embodiment 3 is not described, either, as it is the same as that of the air-conditioning apparatus 100A according to Embodiment 2. The air-conditioning apparatus 100B according to Embodiment 3 differs in operation of the cooling start-up control function from the air-conditioning apparatus 100A according to Embodiment 2. Therefore, the following description is given with a focus on the operation of the cooling start-up control function of the air-conditioning apparatus 100B according to Embodiment 3.

[Cooling Start-Up Control Function During Cooling Operation Mode]

Figure 12:
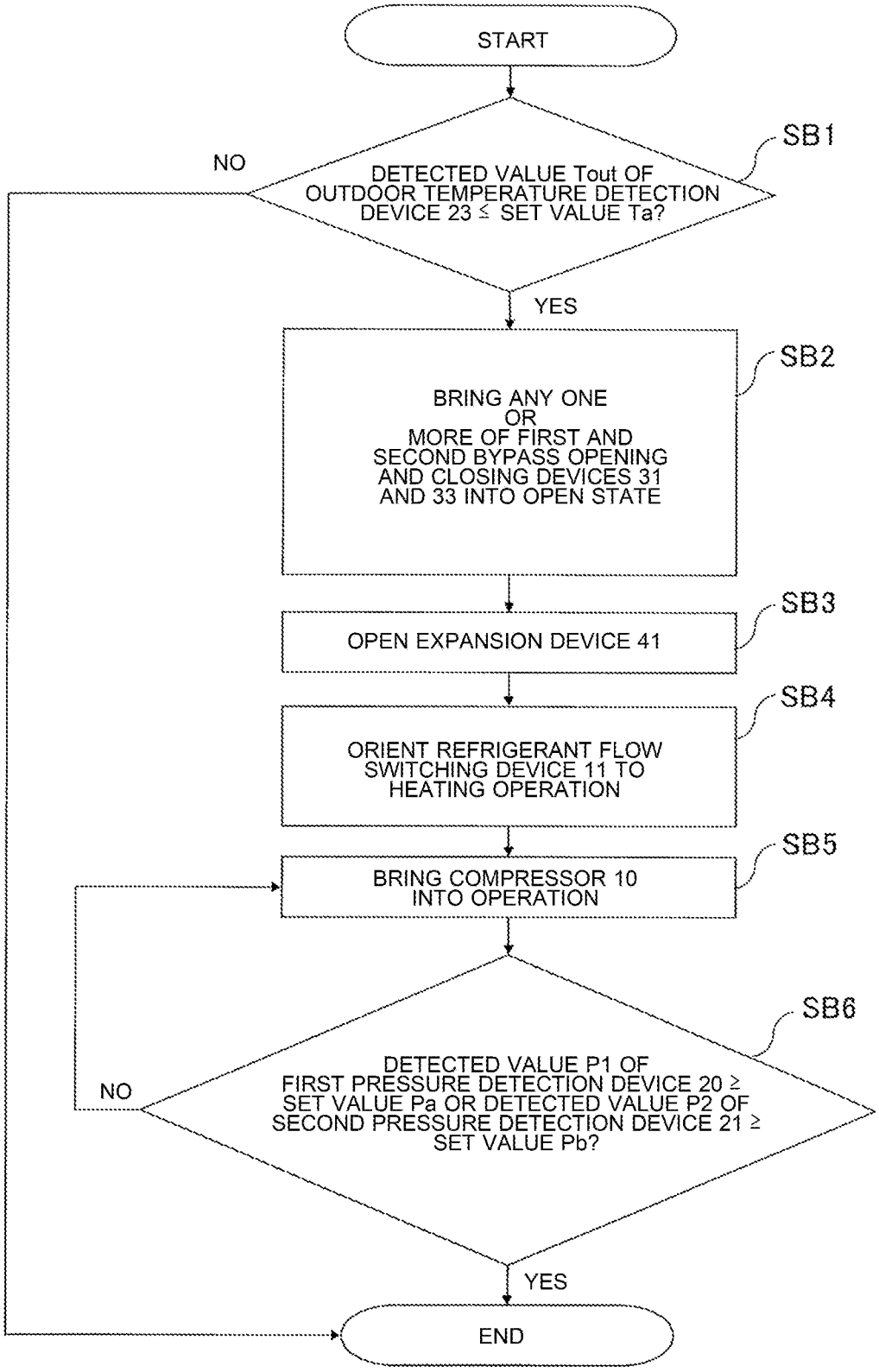
FIG. 12 is a flow chart showing operation of a cooling start-up control function of the air-conditioning apparatus according to Embodiment 3.

FIG. 12 is a flow chart showing operation of a cooling start-up control function of the air-conditioning apparatus 100B according to Embodiment 3. The following describes, with reference to FIG. 12, the cooling start-up control function of, at the start of cooling operation under low outside air temperature conditions, purging refrigerant accumulated in the accumulator 13 of the air-conditioning apparatus 100B according to Embodiment 3.

FIG. 12 is a flow chart representing operation of the cooling start-up control function during a cooling operation mode of the air-conditioning apparatus 100B. When the remote controller 35 is operated by a user and cooling operation gets started, the air-conditioning apparatus 100B starts the cooling start-up control function and performs an operation according to the flow chart shown in FIG. 12. As for various devices in the air-conditioning apparatus 100B whose actions are not defined in the flow chart shown in FIG. 12, actions are performed according to the aforementioned cooling operation mode.

First, the controller 24 determines whether a detected temperature Tout of the outdoor temperature detection device 23 is less than or equal to a set value Ta, which is an arbitrary set value (step SB1). The set value Ta may be set, for example, to 5 degrees Celsius, as liquid refrigerant is more easily accumulated in the accumulator 13 at lower outdoor temperatures. In a case in which the controller 24 has determined that the detected temperature Tout of the outdoor temperature detection device 23 is greater than the set value Ta (NO in step SB1), the controller 24 performs the operation of the aforementioned cooling operation mode without carrying out the cooling start-up control function. In a case in which the controller 24 has determined that the detected temperature Tout of the outdoor temperature detection device 23 is less than or equal to the set value Ta (YES in step SB1), the controller 24 determines that liquid refrigerant is present in the accumulator 13, and proceeds to a process of executing step SB2.

Next, the controller 24 brings either one or more of the first bypass opening and closing device 31 and the second bypass opening and closing device 33 into an open state (step SB2). In step SB2, although the controller 24 is supposed to open either one of the two bypass opening and closing devices, the more bypass opening and closing devices are opened, the earlier the air-conditioning apparatus 100B can gasify the liquid refrigerant contained in the accumulator 13. Having performed the process of step SB2, the controller 24 proceeds to a process of executing step SB3.

Next, the controller 24 brings the opening degree of the expansion device 41 into an open state (step SB3). Having performed the process of step SB3, the controller 24 proceeds to a process of executing step SB4.

Next, the controller 24 orients the refrigerant flow switching device 11 to the heating operation mode so that the refrigerant discharged from the compressor 10 is supplied to the load side heat exchanger 53 (step SB4). In so doing, making the opening degree of the expansion device 41 a totally-open or almost totally-open opening degree results in a reduced pressure loss in the expansion device 41. Therefore, the air-conditioning apparatus 100B can reduce the pressure of refrigerant flowing into the load side heat exchanger 53. This reduces the amount of refrigerant that condenses in the load side heat exchanger 53, and therefore makes it easy for gas refrigerant to return to the accumulator 13. Having performed the process of step SB4, the controller 24 proceeds to a process of executing step SB5.

Next, the controller 24 brings the compressor 10 into operation (step SB5). That is, the controller 24 brings the compressor 10 into operation after, at the start of cooling operation, switching the refrigerant flow switching device 11 to an orientation to heating operation and bringing at least one or more bypass opening and closing devices into an open state. Bringing the compressor 10 into operation based on the processes from step SB1 to step SB5 causes high-temperature and high-pressure gas refrigerant discharged from the compressor 10 to pass through either one or more of the first bypass pipe 30 and the second bypass pipe 32. Then, the high-temperature and high-pressure gas refrigerant discharged from the compressor 10 passes through a bypass opening and closing device such as the first bypass opening and closing device 31 or the second bypass opening and closing device 33 to flow into the accumulator 13. The high-temperature and high-pressure gas refrigerant discharged from the compressor 10 is decompressed into low-pressure refrigerant while passing through the bypass opening and closing device such as the first bypass opening and closing device 31. Then, since refrigerant drops in temperature when decompressed, the refrigerant having just passed through the bypass opening and closing device such as the first bypass opening and closing device 31 turns into low-pressure intermediate-temperature refrigerant. This low-pressure intermediate-temperature refrigerant is low-pressure gas refrigerant with a high degree of superheat that is capable of evaporating the refrigerant contained in the accumulator 13. The air-conditioning apparatus 100B allows the gas refrigerant with a high degree of superheat discharged from the compressor 10 to bypass the heat source side heat exchanger 12 or the load side heat exchanger 53 and flow directly into the accumulator 13. As a result, by causing the low-pressure gas refrigerant with a high degree of superheat to flow into the accumulator 13, the air-conditioning apparatus 100B can raise the system pressure of the refrigeration cycle by heating, evaporating, and thereby gasifying the liquid refrigerant accumulated in the accumulator 13. Having performed the process of step SB5, the controller 24 proceeds to a determination process of step SB6.

In step SB5, the controller 24 may exercise control so that the indoor air-sending device 54 stops or the rotation speed of the indoor air-sending device 54 decreases. When the controller 24 exercises control so that the indoor air-sending device 54 stops or the rotation speed of the indoor air-sending device 54 decreases, the air-conditioning apparatus 100B can reduce the amount of refrigerant that condenses in the load side heat exchanger 53. As a result, the air-conditioning apparatus 100B can efficiently gasify the refrigerant accumulated in the accumulator 13. Further, in the cooling start-up control function of the air-conditioning apparatus 100B according to Embodiment 3, the refrigerant flow switching device 11 is oriented to the heating operation mode, so that the air-conditioning apparatus 100B acts in a manner similar to that in which it acts during the heating operation mode, during which the load side heat exchanger 53 serves as a condenser. Therefore, the air-conditioning apparatus 100B needs to stop the indoor air-sending device 54 or decrease the rotation speed of the indoor air-sending device 54 so that the indoor air is not heated.

Next, the controller 24 determines whether a detected value P1 of the first pressure detection device 20 is greater than or equal to the set value Pa, which is an arbitrary set value, and determines whether a detected value P2 of the second pressure detection device 21 is greater than or equal to the set value Pb, which is an arbitrary set value. Then, the controller 24 determines whether either the condition that the detected value P1 of the first pressure detection device 20 is greater than or equal to the set value Pa or the condition that the detected value P2 of the second pressure detection device 21 is greater than or equal to the set value Pb is met (step SB6). In a case in which the controller 24 has determined that either of the conditions is met (YES in step SB6), the controller 24 determines that the liquid refrigerant has been successfully purged from the accumulator 13, terminates the cooling start-up control function, and shifts to a normal cooling operation mode. In a case in which the controller 24 has determined that neither of the conditions is met (NO in step SB6), the controller 24 determines that the liquid refrigerant is present in the accumulator 13, and returns to the determination process of step SB5.

It should be noted that the method for determining a condition for the termination of the cooling start-up control function in step SB6 is not limited to the aforementioned method. The termination of the cooling start-up control function may be determined by a value that is calculated by the detected value of the first pressure detection device 20 or the detected value of the second pressure detection device 21, for example, the saturation temperature of refrigerant or other values. Alternatively, the termination of the cooling start-up control function may be done by providing, at an inflow side of the accumulator 13, a temperature detection device (not illustrated) configured to detect the temperature of refrigerant, calculating a degree of superheat of refrigerant flowing into the accumulator 13, and using the degree of superheat as a value for determination of a termination condition. Alternatively, the controller 24 may use the time-measuring device 27 to terminate the cooling start-up control function in a case in which a period of time elapsed after the start of the cooling start-up control function reaches a set period of time. That is, the controller 24 may terminate the start-up control function in a case in which the detected value of at least one or more of the first pressure detection device 20 and the second pressure detection device 21 is less than or equal to a threshold or a case in which the period of time elapsed after the start of the start-up control function reaches the set period of time.

By carrying out the cooling start-up control function, the air-conditioning apparatus 100B can efficiently gasify the liquid refrigerant accumulated in the accumulator 13. At the start of cooling operation under low outside air temperature conditions, the air-conditioning apparatus 100B can improve deterioration of the cooling capacity due to formation of frost on the load side heat exchanger 53 due to a decrease in system pressure due to accumulation of a large amount of refrigerant in the accumulator 13.

[Working Effects of Air-Conditioning Apparatus 100B]

The air-conditioning apparatus 100B includes a controller 24 configured to control the bypass opening and closing device to carry out a start-up control function of causing low-pressure gas refrigerant with a high degree of superheat to flow into the accumulator 13. Therefore, even under low outdoor temperature operating conditions, the air-conditioning apparatus 100B can circulate refrigerant through the inside of the refrigerant circuit 101 by gasifying liquid refrigerant accumulated in the accumulator 13. As a result, even under low outdoor temperature operating conditions, the air-conditioning apparatus 100B can reduce deterioration of capacity due to freezing of the heat medium during cooling operation.

As shown in FIG. 6, the air-conditioning apparatus 100B may carry out the cooling start-up control function in a case in which the detected value of the first pressure detection device 20 or the second pressure detection device 21 is less than or equal to the set value. Accordingly, in starting the air-conditioning operation of the air-conditioning apparatus 100B, the controller 24 can carry out the start-up control function based on the detected value of at least one or more of the outdoor temperature detection device 23, the first pressure detection device 20, and the second pressure detection device 21. In this case, the controller 24 carries out the cooling start-up control function if any one of the condition that the detected value P1 of the first pressure detection device 20 is less than or equal to a set value Pf, the condition that the detected value P2 of the second pressure detection device 21 is less than or equal to a set value Pg, and the condition that the detected temperature Tout of the outdoor temperature detection device 23 is less than or equal to the set value Ta is met in step SB1. Further, although the condition for the start of the cooling start-up control function shown in FIG. 12 begins at the start of cooling operation, a condition for the start of a cooling start-up control function does not need to begin at the start of cooling operation. For example, even in a state in which the air-conditioning apparatus 100B is under suspension, the air-conditioning apparatus 100B may carry out the cooling start-up control function at regular time intervals. While the air-conditioning apparatus 100B is under suspension, the controller 24 can carry out the start-up control function based on the detected value of at least one or more of the outdoor temperature detection device 23, the first pressure detection device 20, and the second pressure detection device 21 at set time intervals. In this case, the controller 24 carries out the cooling start-up control function in a case in which the detected value of less than or equal to the set value. That is, the controller 24 carries out the cooling start-up control function if any one of the condition that the detected value P1 of the first pressure detection device 20 is less than or equal to the set value Pf, the condition that the detected value P2 of the second pressure detection device 21 is less than or equal to the set value Pg, and the condition that the detected temperature Tout of the outdoor temperature detection device 23 is less than or equal to the set value Ta is met in step SB1. Since the air-conditioning apparatus 100B can prevent accumulation of refrigerant in the accumulator 13 by executing the cooling start-up control function, the air-conditioning apparatus 100B can prevent the heat medium from freezing at the start of cooling operation under low outside air temperature conditions.

Further, the cooling start-up control function of the air-conditioning apparatus 100A according to Embodiment 2 has a risk that frost may form on the load side heat exchanger 53, as low-temperature and low-pressure refrigerant is passed through the load side heat exchanger 53. However, the cooling start-up control of the air-conditioning apparatus 100B according to Embodiment 3 has an advantage that there is no risk that frost may form on the load side heat exchanger 53, as high-temperature and high-pressure refrigerant is supplied to the load side heat exchanger 53.

Further, the cooling start-up control function of the air-conditioning apparatus 100B according to Embodiment 3 is also effective in a secondary-loop air-conditioning apparatus 100 composed of a refrigerant circuit 101 and a heat medium circuit 102 as typified by the air-conditioning apparatus according to Embodiment 1. For example, the cooling start-up control function of the air-conditioning apparatus 100B according to Embodiment 3 shown in FIG. 12 may be applied directly to the air-conditioning apparatus 100 according to Embodiment 1. In this case, the air-conditioning apparatus 100 is configured such that gas discharged from the compressor 10 is supplied to the heat medium heat exchanger 61, so that there is no longer a risk that the heat medium may freeze in the heat medium heat exchanger 61.

Further, the controller 24 brings the compressor 10 into operation after, at the start of cooling operation, switching the refrigerant flow switching device 11 to an orientation to heating operation and bringing at least one or more bypass opening and closing devices into an open state. As a result, the air-conditioning apparatus 100B reduces the amount of refrigerant that condenses in the load side heat exchanger 53, and therefore makes it easy for gas refrigerant to return to the accumulator 13.

Further, although the diagrams representing examples of the circuit configurations of the air-conditioning apparatus 100 or other air-conditioning apparatuses according to Embodiment 1 to 3 described above are drawn such the bypass pipes and the bypass opening and closing devices are situated inside the outdoor unit 1 and the heat medium relay unit 60, the air-conditioning apparatus 100 or other air-conditioning apparatuses are not limited to these configurations. The air-conditioning apparatus 100 or other air-conditioning apparatuses may be configured such that the bypass pipes and the bypass opening and closing devices may be provided outside the outdoor unit 1 and the heat medium relay unit 60. Even with this configuration, the air-conditioning apparatus 100 or other air-conditioning apparatuses can bring about similar effects.

Figure 13:
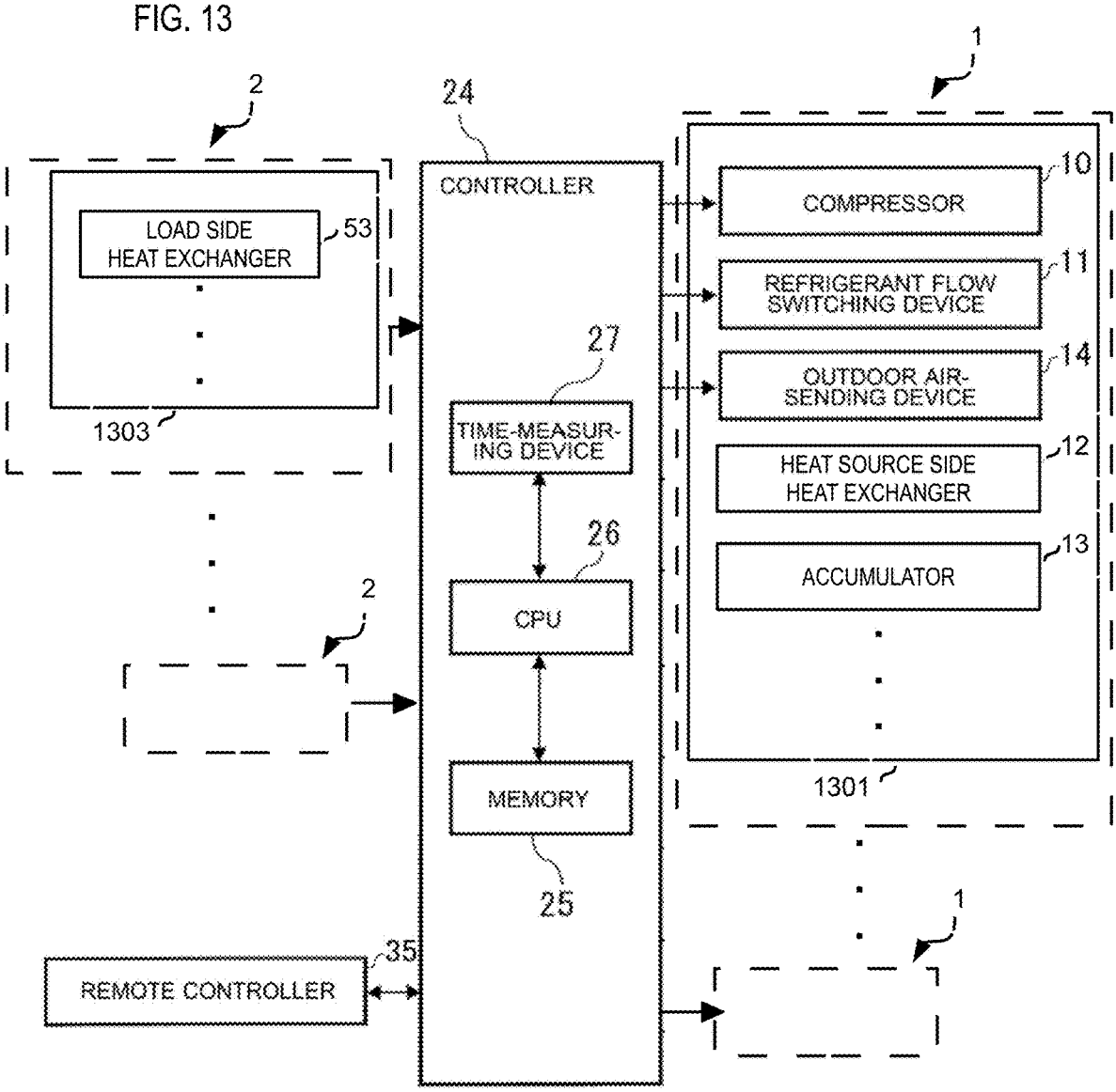
FIG. 13 is a block diagram of a further embodiment of an air-conditioning apparatus.

Further, although, in Embodiments 1 to 3, the air-conditioning apparatus 100 or other air-conditioning apparatuses have been described by taking as an example a case in which there is only one outdoor unit 1, the number of outdoor units 1 is not limited to 1. That is, the air-conditioning apparatus 100 or other air-conditioning apparatuses may include a plurality of outdoor units 1 each having at least the compressor 10, the refrigerant flow switching device 11, the heat source side heat exchanger 12, and the accumulator 13 housed in a housing, 1301, illustrated in FIG. 13. Each of the plurality of outdoor units 1 is controlled by the controller 24 to carry out an operation based on the start-up control function. The air-conditioning apparatus 100 or other air-conditioning apparatuses need only be configured such that each of the plurality of outdoor units 1 carries out cooling and heating start-up control functions defined in each embodiment. Even with the plurality of outdoor units 1, the air-conditioning apparatus 100 or other air-conditioning apparatuses can bring about similar effects.

The air-conditioning apparatus 100 or other air-conditioning apparatuses are not limited to a system in which a plurality of indoor units 2 are connected and in which all indoor units 2 connected simultaneously perform only either cooling operation or heating operation. The air-conditioning apparatus 100 or other air-conditioning apparatuses may be a system in which a plurality of indoor units 2 are connected and in which the indoor units 2 simultaneously perform cooling operation and heating operation as a whole by individually performing cooling operation or heating operation. That is, the air-conditioning apparatus 100 may include a plurality of indoor units 2 each having at least the load side heat exchanger 53 housed in a housing, 1303, illustrated in FIG. 13, and may be configured to execute an air-conditioning operation mode during which cooling operation by one or more of the plurality of indoor units 2 and heating operation by another one or more of the plurality of indoor units 2 are simultaneously performed. The air-conditioning apparatus 100 or other air-conditioning apparatuses can bring about similar effects, provided they have a circuit in which refrigerant discharged from the compressor 10 bypasses the heat source side heat exchanger 12 or the load side heat exchanger 53.

Further, although Embodiments 1 to 3 have been described by taking as an example a case in which the outdoor unit 1 is mounted with one compressor 10, the outdoor unit 1 may be mounted with two or more compressors 10.

It should be noted that Embodiments 1 to 3 may be carried out in combination with one another. The configurations shown in the foregoing embodiments show examples and may be combined with another publicly-known technology, and parts of the configurations may be omitted or changed, provided such omissions and changes do not depart from the scope.

REFERENCE SIGNS LIST

1: outdoor unit, 2: indoor unit, 3: refrigerant main pipe, 4: refrigerant pipe, 10: compressor, 11: refrigerant flow switching device, 12: heat source side heat exchanger, 13: accumulator, 14: outdoor air-sending device, 20: first pressure detection device, 21: second pressure detection device, 22: first temperature detection device, 23: outdoor temperature detection device, 24: controller, 25: memory, 26: CPU, 27: time-measuring device, 30: first bypass pipe, 31: first bypass opening and closing device, 32: second bypass pipe, 33: second bypass opening and closing device, 35: remote controller, 41: expansion device, 42: third bypass pipe, 43: third bypass opening and closing device, 50: second temperature detection device, 51: third temperature detection device, 52: fourth temperature detection device, 53: load side heat exchanger, 54: indoor air-sending device, 60: heat medium relay unit, 61: heat medium heat exchanger, 62: pump, 63: heat medium flow control device, 64: heat medium pipe, 100: air-conditioning apparatus, 100A: air-conditioning apparatus, 100B: air-conditioning apparatus, 101: refrigerant circuit, 102: heat medium circuit

The invention claimed is:

1. An air-conditioning apparatus comprising:

a refrigerant circuit in which a compressor, a refrigerant flow switching valve, a heat source side heat exchanger, an expansion valve, a heat medium heat exchanger, and an accumulator are connected by a refrigerant pipe and through which refrigerant circulates;

a heat medium circuit in which a pump, the heat medium heat exchanger, a heat medium flow control valve, and a load side heat exchanger are connected by a heat medium pipe and through which a heat medium circulates;

at least one or more bypass pipes provided in the refrigerant circuit so that the refrigerant discharged from the compressor bypasses the heat source side heat exchanger and the heat medium heat exchanger;

for at least one bypass pipe of the at least one or more bypass pipes, a bypass opening and closing valve is provided at a midpoint in a pipe conduit of the at least one bypass pipe; and a controller configured to control the bypass opening and closing valve to carry out a start-up control function of causing refrigerant from the compressor to become low-pressure gas refrigerant with a high degree of superheat, whereby refrigerant from the compressor flows directly into the accumulator via the bypass opening and closing valve.

2. The air-conditioning apparatus of claim 1, wherein the controller is configured to activate the compressor after having activated the pump and the heat medium flow control valve device.

3. The air-conditioning apparatus of claim 1, further comprising any one or more of an outdoor temperature sensor configured to detect an outdoor ambient temperature, a first pressure sensor configured to detect a discharge pressure of the compressor, and a second pressure sensor configured to detect a suction pressure of the compressor, wherein in starting air-conditioning operation, the controller is configured to carry out the start-up control function based on a detected value of at least one or more of the outdoor temperature sensor, the first pressure sensor, and the second pressure sensor in a case in which the detected value is less than or equal to a set value.

4. The air-conditioning apparatus of claim 3, wherein the controller is configured to terminate the start-up control function in a case in which the detected value of at least one or more of the first pressure sensor and the second pressure sensor is greater than or equal to a threshold or a case in which a period of time elapsed after a start of the start-up control function reaches a set period of time.

5. The air-conditioning apparatus of claim 1, further comprising any one or more of an outdoor temperature sensor configured to detect an outdoor ambient temperature, a first pressure sensor configured to detect a discharge pressure of the compressor, and a second pressure sensor configured to detect a suction pressure of the compressor, wherein while the air-conditioning apparatus is under suspension, the controller is configured to carry out the start-up control function based on a detected value of at least one or more of the outdoor temperature sensor, the first pressure sensor, and the second pressure sensor at set time intervals in a case in which the detected value is less than or equal to a set value.

6. The air-conditioning apparatus of claim 1, wherein there is one or more of the bypass opening and closing valve for the at least one bypass pipe, wherein the controller is configured to bring the compressor into operation after, at a start of cooling operation, bringing at least one of the one or more of the bypass opening and closing valve into an open state.

7. The air-conditioning apparatus of claim 1, wherein there is one or more of the bypass opening and closing valve for the at least one bypass pipe, wherein the controller is configured to bring the compressor into operation after, at a start of cooling operation, switching the refrigerant flow switching valve to an orientation to heating operation and bringing at least one of the one or more of the bypass opening and closing valve into an open state.

8. The air-conditioning apparatus of claim 1, wherein there is one or more of the bypass opening and closing valve for the at least one bypass pipe, wherein the controller is configured to bring the compressor into operation after, at a start of heating operation, bringing at least one of the one or more of the bypass opening and closing valve into an open state.

9. The air-conditioning apparatus of claim 1, further comprising a plurality of outdoor units, each outdoor unit of the plurality of outdoor units respectively having a housing, the each outdoor unit respectively having, housed in the housing, at least the compressor, the refrigerant flow switching valve, the heat source side heat exchanger, and the accumulator, wherein the each outdoor unit of the plurality of outdoor units is configured to carry out an operation based on the start-up control function.

10. The air-conditioning apparatus of claim 1, further comprising a plurality of indoor units, each indoor unit of the plurality of indoor units respectively having a housing, the each indoor unit respectively having, housed in the housing, at least the load side heat exchanger, wherein the air-conditioning apparatus is configured to operate in an air-conditioning operation mode during which cooling operation by one or more of the plurality of indoor units and heating operation by another one or more of the plurality of indoor units are simultaneously performed.

11. An air-conditioning apparatus comprising:

a refrigerant circuit in which a compressor, a refrigerant flow switching valve, a heat source side heat exchanger, an expansion valve, a load side heat exchanger, and an accumulator are connected by a refrigerant pipe and through which refrigerant circulates;

at least one or more bypass pipes provided in the refrigerant circuit so that the refrigerant discharged from the compressor bypasses the heat source side heat exchanger and the load side heat exchanger;

for at least one bypass pipe of the at least one or more bypass pipes, a bypass opening and closing valve is provided at a midpoint in a pipe conduit of the at least one bypass pipe; and a controller configured to control the bypass opening and closing valve to carry out a start-up control function of causing refrigerant from the compressor to become low-pressure gas refrigerant with a high degree of superheat, whereby refrigerant from the compressor flows directly into the accumulator via the bypass opening and closing valve.

12. The air-conditioning apparatus of claim 11, further comprising any one or more of an outdoor temperature sensor configured to detect an outdoor ambient temperature, a first pressure sensor configured to detect a discharge pressure of the compressor, and a second pressure sensor configured to detect a suction pressure of the compressor, wherein in starting air-conditioning operation, the controller is configured to carry out the start-up control function based on a detected value of at least one or more of the outdoor temperature sensor, the first pressure sensor, and the second pressure sensor in a case in which the detected value is less than or equal to a set value.

13. The air-conditioning apparatus of claim 12, wherein the controller is configured to terminate the start-up control function in a case in which the detected value of at least one or more of the first pressure sensor and the second pressure sensor is greater than or equal to a threshold or a case in which a period of time elapsed after a start of the start-up control function reaches a set period of time.

14. The air-conditioning apparatus of claim 11, further comprising any one or more of an outdoor temperature sensor configured to detect an outdoor ambient temperature, a first pressure sensor configured to detect a discharge pressure of the compressor, and a second pressure sensor configured to detect a suction pressure of the compressor, wherein while the air-conditioning apparatus is under suspension, the controller is configured to carry out the start-up control function based on a detected value of at least one or more of the outdoor temperature sensor, the first pressure sensor, and the second pressure sensor at set time intervals in a case in which the detected value is less than or equal to a set value.

15. The air-conditioning apparatus of claim 11, wherein there is one or more of the bypass opening and closing valve for the at least one bypass pipe, wherein the controller is configured to bring the compressor into operation after, at a start of cooling operation, bringing at least one of the one or more of the bypass opening and closing valve into an open state.

16. The air-conditioning apparatus of claim 11, wherein there is one or more of the bypass opening and closing valve for the at least one bypass pipe, wherein the controller is configured to bring the compressor into operation after, at a start of cooling operation, switching the refrigerant flow switching valve to an orientation to heating operation and bringing at least one of the one or more of the bypass opening and closing valve into an open state.

17. The air-conditioning apparatus of claim 11, wherein there is one or more of the bypass opening and closing valve for the at least one bypass pipe, wherein the controller is configured to bring the compressor into operation after, at a start of heating operation, bringing at least one of the one or more of the bypass opening and closing valve into an open state.

18. The air-conditioning apparatus of claim 11, further comprising a plurality of outdoor units, each outdoor unit of the plurality of outdoor units respectively having a housing, the each outdoor unit respectively having, housed in the housing, at least the compressor, the refrigerant flow switching valve, the heat source side heat exchanger, and the accumulator, wherein the each outdoor unit of the plurality of outdoor units is configured to carry out an operation based on the start-up control function.

19. The air-conditioning apparatus of claim 11, further comprising a plurality of indoor units, each indoor unit of the plurality of indoor units respectively having a housing, the each indoor unit respectively having, housed in the housing, at least the load side heat exchanger, wherein the air-conditioning apparatus is configured to execute an air-conditioning operation mode during which cooling operation by one or more of the plurality of indoor units and heating operation by another one or more of the plurality of indoor units are simultaneously performed.

* * * * *